US010702767B2

(12) United States Patent
Campos et al.

(10) Patent No.: US 10,702,767 B2
(45) Date of Patent: Jul. 7, 2020

(54) INTEGRATED MULTI ENVIRONMENT INTERACTIVE BATTLE GAME

(71) Applicant: Hasbro, Inc., Pawtucket, RI (US)

(72) Inventors: Ramon Antonio Campos, Glendale, CA (US); Michelino Paolino, Jr., Rumford, RI (US); Douglas Arthur Schultheis, Cumberland, RI (US); Luke Lohan, Abington, MA (US)

(73) Assignee: Hasbro, Inc., Pawtucket, RI (US)

( * ) Notice: Subject to any disclaimer, the term of this patent is extended or adjusted under 35 U.S.C. 154(b) by 0 days.

(21) Appl. No.: 16/218,109

(22) Filed: Dec. 12, 2018

(65) Prior Publication Data

US 2019/0184278 A1 Jun. 20, 2019

Related U.S. Application Data

(60) Provisional application No. 62/613,352, filed on Jan. 3, 2018, provisional application No. 62/598,768, filed on Dec. 14, 2017.

(51) Int. Cl.

| | |
|---|---|
| ***A63H 1/06*** | (2006.01) |
| ***A63H 1/00*** | (2019.01) |
| ***A63F 9/16*** | (2006.01) |
| ***A63H 1/04*** | (2006.01) |
| *A63F 9/24* | (2006.01) |

(52) U.S. Cl.

CPC ..... *A63F 9/16* (2013.01); *A63H 1/04* (2013.01); *A63F 2009/2485* (2013.01)

(58) Field of Classification Search

USPC ..... 446/233–238, 256, 263

See application file for complete search history.

(56) References Cited

U.S. PATENT DOCUMENTS

| | | | |
|---|---|---|---|
| 755,446 | A | 3/1904 | Butcher |
| 1,594,649 | A | 8/1926 | Trautmann |
| 2,148,374 | A | 2/1939 | Hogan |
| 2,195,083 | A | 3/1940 | Einfalt |
| 2,364,117 | A | 12/1944 | Wigal |
| 2,611,995 | A | 9/1952 | Krapp |
| 2,736,132 | A | 2/1956 | Murray |
| 3,229,416 | A | 1/1966 | Bross |
| 3,235,259 | A | 2/1966 | Glass et al. |
| 3,531,892 | A | 10/1970 | Pearce |

(Continued)

FOREIGN PATENT DOCUMENTS

| | | |
|---|---|---|
| JP | 4659153 B2 | 3/2008 |
| WO | 2013016317 A2 | 1/2013 |

OTHER PUBLICATIONS

EP 18212705.0 Communication of European Search Report with Written Opinion, Search papers dated Apr. 29, 2019.

*Primary Examiner* — Nini F Legesse

(74) *Attorney, Agent, or Firm* — Perry Hoffman

(57) ABSTRACT

Gaming systems and methods for a battling game which may use two or four physical toy tops and a stadium-shaped toy game board arena for physical game play interactions between game players. The battling 2-in-1 stadium battle dome allows a number of users to play on one side and then flip over to play on the other, encouraging 2 and 4 player battles. The stadium is shaped like a dome, enclosed on both sides, and there are two different sides to play on, overall creating four different play surfaces. The toy has double sided suspended play surfaces for corresponding game play with various surfaces of the different sides.

20 Claims, 14 Drawing Sheets

(56) References Cited

U.S. PATENT DOCUMENTS

| | | | |
|---|---|---|---|
| 3,864,870 | A | 2/1975 | Breslow et al. |
| 3,945,146 | A | 3/1976 | Brown |
| 4,185,739 | A | 1/1980 | Wilford |
| 4,261,466 | A | 4/1981 | Wilford |
| 4,476,650 | A | 10/1984 | Lokvig |
| 4,695,262 | A | 9/1987 | Crosby et al. |
| 4,713,039 | A | 12/1987 | Wong |
| 4,867,727 | A | 9/1989 | Lanius |
| 4,959,035 | A | 9/1990 | Murasaki |
| 4,982,961 | A | 1/1991 | Ichimura |
| 5,110,128 | A | 5/1992 | Robbins |
| 5,411,138 | A | 5/1995 | Klawiter |
| 5,458,523 | A | 10/1995 | Aoki et al. |
| 5,823,845 | A | 10/1998 | O'Berrigan |
| 5,896,991 | A | 4/1999 | Hippely et al. |
| 5,957,745 | A | 9/1999 | Johnson et al. |
| 6,099,380 | A | 8/2000 | Rasmussen |
| 6,270,391 | B1 | 8/2001 | Emilsson |
| 6,280,286 | B1 | 8/2001 | Andrews |
| 6,406,349 | B1 | 6/2002 | Chung |
| 6,676,476 | B1 | 1/2004 | Lund et al. |
| 7,037,169 | B2 | 5/2006 | Benedek et al. |
| 7,296,679 | B2 | 11/2007 | Lam |
| 7,389,987 | B1 | 6/2008 | Paukert |
| 7,475,881 | B2 | 1/2009 | Blagg et al. |
| 7,740,518 | B2 | 6/2010 | Elliott |
| 8,137,151 | B2 | 3/2012 | Kenney |
| 8,757,628 | B1 | 6/2014 | Baker |
| 9,962,615 | B2 | 5/2018 | Lema et al. |
| 2003/0168801 | A1 | 9/2003 | Zucchi et al. |
| 2004/0040349 | A1 | 3/2004 | Guttadauro et al. |
| 2005/0104294 | A1 | 5/2005 | Chen |
| 2006/0255149 | A1 | 11/2006 | Retter et al. |
| 2013/0324004 | A1 | 12/2013 | Schwartz |
| 2016/0030848 | A1 | 2/2016 | Lema |
| 2016/0035178 | A1 | 2/2016 | Judkins et al. |

INTEGRATED MULTI ENVIRONMENT INTERACTIVE BATTLE GAME

PRIORITY CROSS-REFERENCE TO RELATED APPLICATION

This application claims priority pursuant to 35 U.S.C. 119(e) or 120 from U.S. Provisional Application No. 62/598,768 filed Dec. 14, 2017 and U.S. Provisional Application No. 62/613,352 filed Jan. 3, 2018 for inventions disclosed therein incorporated by reference.

FIELD OF THE INVENTION

The present invention relates to a battle arena game apparatus, and more particularly, to a battle arena or stadium game apparatus with multiple launch openings and slide regions guiding spinning toy battle tops in a one way flow toward battling surfaces for engaging the tops in combat where the arena accommodates two players when placed in one orientation and four players after being flipped to another orientation.

BACKGROUND OF THE INVENTION

The inventions discussed in connection with the described embodiments address various deficiencies of the prior art. The present inventions address a gaming system involving interactions between game players. The described embodiments concern Beyblade™ spinning tops as the physical game pieces. The described Beyblade™ spinning top usually includes a device, such as a ripcord, to help a player make the top spin. One or more players may engage in games where one or more players spin two or more tops so that the tops may "battle", where the player whose top is the last top spinning wins. The "battle" may include the tops colliding one or more times. The tops may have different designs where each design causes a top to respond to collisions in a unique way, thus adding a skill element to choosing opposing tops.

In some of the embodiments, the game may further enhance play by maximizing the frequency of collisions and interactions between actively spinning tops by guiding the tops in a one way flow pattern from the launch openings to the battling or game surfaces. A circular wall at least partially forming a raised perimeter around the battling or game surfaces prevents spinning tops from exiting back out of the battling or game surfaces and instead directing the spinning tops to the middle of the battling or game surfaces where collisions are most likely to occur.

In some embodiments, the game may further use physical game battle arena game apparatus in an integrated multi-environment interactive battle game physical game board, convertible or converting arena, e.g., being turned upside down and used as a stadium for plural or multiple players to spin two or more Beyblade™ tops so that the tops battle within the stadium confines by spinning and knocking into each other until only one top remains spinning.

There are known toy top play pads, toy top entertainment systems, and battle arenas which provide a surface along which toy tops are spun, travel in a specified direction along a rail element, or travel around on a circular platform. It is known to employ a circular arena for providing a surface on which toy tops can spin and possibly interact with one another, or to provide a rail element to guide a toy top along the direction of the rail.

There is a known toy top play pad which employs a circular launch pad and runway pad in juxtaposition with the launch pad as exemplified and disclosed in JP4659153 titled Game Table for a toy top, issued Mar. 27, 2008 to Jenoido Proto Design KK. Toy tops are spun into the circular launch pad where they revolve around the perimeter of the concave launch pad and discharge onto a runway pad in a racing fashion. A guide plate directs the tops only from the launch pad to the running pad where a user can race tops through running grooves and compete for running speeds.

The running grooves are carved into the runway pad and are designed to capture a tip of the toy tops as they enter the runway pad. The running grooves cut into the surface of the runway pad and direct the tops to circle around the perimeter of the play pad. The tip of each toy top comes into point contact with the bottom surface of the running groove to allow the toy top to travels within the running groove and circle the perimeter of the play pad in a racing fashion.

The circular launch pad is only a landing pad for toy tops to be introduced to the play pad before they are captured by the running grooves as the toy tops circle the outer perimeter of the circular launching pad. The toy tops enter the running grooves and are then directed around the runway pad circuit in a racing fashion and never collide in the circular launch pad nor are the runway pads guiding the tops into the middle of the circular launch pad to encourage collisions between the spinning toy tops. There is only an entrance into the runway pad from the circular launching pad, and the guiding plates are configured as such as to only direct tops from the perimeter of the circular launching pad to the running grooves. There is no disclosure for an exit from the runway pad to the circular launching pad for launching tops back onto the circular launch pad to collide with other spinning tops. There are no designated exits at the running pads to redirect spinning tops from the periphery of the circular launching pad, back into the middle of the circular launch pad.

There is also a known toy top entertainment system with interchangeable top components and interchangeable rail arrangements as exemplified and disclosed in WO 2013/016317 A2 Dynamic Entertainment System, published Jan. 31, 2013 to Gaines. The top entertainment system discloses interchangeable tops engaging and riding along interchangeable rail elements to maximize vector velocity in transit along the rail elements. The toy tops are launched onto a flat launch support adjacent a rail element. The tops have a ring with a ring side wall perpendicular with a pivoting axis and capable of engaging a rail side wall of the rail elements of the rail path in rolling line contact to travel along the line of the rail path.

Additionally, there are known transformable play sets which transform from one shape to another to allow a user to play and fantasize about the interchangeability of shapes. Known transformable toys include toys which manually convert from one shape to another such as a car transforming to a plane, etc., or an environmental scene such as a parking garage with ramps for toy cars, transformable to a different environmental scene by triggering a single actuator, or one game surface rotating around to display another game surface.

Significantly, known toy top play pads and arenas do not include or teach an integrated multi-environment interactive battle game physical game board, convertible or converting arena, e.g., being turned upside down and used as a stadium for engaging spinning toy tops in combat where the arena accommodates two players when placed in one orientation and four players after being flipped to another orientation.

Plural or multiple players spin two or more Beyblade™ tops so that the tops battle within the stadium confines by spinning and knocking into each other until only one top remains spinning. It is desirable to maximizing the frequency of collisions and interactions between actively spinning tops by guiding the tops in a one way flow pattern from the launch openings to the battling or game surfaces. A circular wall at least partially forming a raised perimeter around the battling or game surfaces prevents spinning tops from exiting back out of the battling or game surfaces and instead directing the spinning tops to the middle of the battling or game surfaces where collisions are most likely to occur.

SUMMARY AND FEATURES OF THE INVENTIONS

The present invention relates to battle arena game apparatus for games of battle tops in which spinning tops are dropped into the arena and collide with one another, having combat, until only one top remains spinning. The are many advantages to the battle arena including being very compact for shipping, being easily assembled, having rugged, light weight construction, designed to enhance the frequency of collisions between actively spinning tops, and being reversible to accommodate two players on one side and up to four players on a reversed side.

In one embodiment of the invention, a battle game apparatus includes a first lid having two launch openings to enable two players to each insert a spinning battle top through a corresponding launch opening of the first lid, a second lid having four launch openings to enable four players to each insert a spinning battle top through a corresponding launch opening of the second lid, and a first base having a battling surface to enable spinning battle tops inserted through the two launch openings of the first lid to engage each other in combat. A second base is further included for mounting the first and second lids and having a support surface and a battling surface, the support surface for mounting the first base, and the battling surface to enable spinning battle tops inserted through the launch openings in the second lid to engage each other in combat.

In another embodiment, the second base further includes a first side and a second side, and a clam shell coupling mounting the first lid to the first side of the second base and a clam shell coupling mounting the second lid to second side of the second base. In another embodiment, the battling surfaces of each of the first and second bases further comprise a circular wall at least partially forming a raised perimeter around each of the battle surfaces.

In still another embodiment, a pair of opposed slanted slide regions flanking the battling surface of the first base and mounted juxtaposed the two launch openings of the first lid are further included, and in another embodiment, two pairs of opposed slanted slide regions flanking the battling surface of the second base and mounted juxtaposed the four launch openings of the second lid are included. In still yet another embodiment, each of the slide regions are slanted toward a battling surface for directing spinning tops from the launch openings to a battling surface.

In yet another embodiment, one or more spinning toy tops in combination, is further included, each top having a tip suitable for gliding down the slide regions from the launch openings to battle at the battling surfaces, and prevented by the circular wall from reentering the slide regions from the battling surfaces to create a one way flow of the one or more tops from the openings to the battling surfaces to maximize collisions between actively spinning tops at the battling surfaces. In another embodiment, one or more electronic sensor devices are included and capable of detecting and monitoring spinning tops on the battling surfaces and wirelessly communicating the spinning top activity to a personal electronic device of a user.

In an embodiment of the invention, a clam shell battle arena game apparatus enabling two and four player orientations, includes a first clam shell housing having two launch openings to enable two players to each insert a spinning battle top through a corresponding launch opening of the first clam shell housing, and a second clam shell housing having four launch openings to enable four players to each insert a spinning battle top through a corresponding launch opening of the second clam shell housing. A base unit having a first side and a second side is further included and coupling to the first clam shell housing at the first side and coupling to the second clam shell housing at the second side. A first battling surface at the first side of the base unit is included to enable spinning battle tops inserted through the two launch openings of the first clam shell opening to engage each other in combat and a second battling surface at the second side of the base unit is included to enable spinning battle tops inserted through the launch openings in the second clam shell housing to engage each other in combat.

In another embodiment, the first and second battling surfaces further include a circular wall at least partially forming a raised perimeter around each of the battling surfaces. In another embodiment, a pair of opposed slanted slide regions flanking the first battling surface are included and mounted juxtaposed the two launch openings of the first clam shell housing, and yet in another embodiment, two pairs of opposed slanted slide regions flanking the second battling surface are included and mounted juxtaposed the four launch openings of the second clam shell housing.

In yet another embodiment, each of the slide regions are slanted toward a battling surface for directing spinning tops from the launch openings to a battling surface. In still another embodiment, one or more spinning toy tops in combination, is further included, each have a tip suitable for gliding down the slide regions from the launch openings to battle at the battling surfaces, and prevented by the circular wall from reentering the slide regions from the battling surfaces to create a one way flow of the one or more tops from the openings to the battling surfaces to maximize collisions between actively spinning tops at the battling surfaces. In still yet another embodiment, one or more electronic sensor devices is included and capable of detecting and monitoring spinning tops on the battling surfaces and wirelessly communicating the spinning top activity to a personal electronic device of a user.

In an embodiment of the invention, a method for making a battle arena game apparatus includes the steps of forming a first lid having two main openings to enable two players to each insert a spinning battle top through a corresponding opening in the first lid, and forming a second lid having four main openings to enable up to four players to each insert a spinning battle top through a corresponding opening in the second lid. Further included are the steps of forming a first base being mountable to a second base, the first base having a game surface to enable spinning battle tops inserted through the first lid to engage each other in combat, and forming the second base for mounting the first base and for mounting the first and second lids, the second base having a game surface to enable multiple spinning battle tops inserted through the second lid to engage each other in combat.

In another embodiment, a further step includes forming a pair of opposed slanted slide regions flanking the game surface of the first base mounted juxtaposed the two main openings of the first lid. In another embodiment a further step includes forming two pairs of opposed slanted slide regions flanking the game surface of the second base mounted juxtaposed the four main openings of the second lid.

In yet another embodiment, a further step includes, combining with one or more spinning toy tops, each top having a tip suitable for gliding down the slide regions from the main openings to battle at the game surfaces, creating a one way flow of the one or more tops from the openings to the game surfaces to maximize collisions between actively spinning tops at the game surfaces. In still yet another embodiment, a further step includes forming at least two play modes, having a first play mode accommodating two players when the battle arena game apparatus is placed in one orientation and a second play mode accommodating four players when placed in another orientation.

Briefly summarized, the present inventions provide a unique battle arena game apparatus which accommodates two players when placed in one orientation and four players after being flipped to another orientation. The arena includes multiple launch openings and slide regions for guiding spinning toy battle tops to flow one way from the launch openings toward the battling surfaces for engaging the tops in combat. The circular wall at least partially forming a raised perimeter around each of the battling surfaces prevents spinning top from exiting the battling surfaces to maximize the frequency of collisions between actively spinning tops for enhanced game play and fun for the user.

BRIEF DESCRIPTION OF THE DRAWINGS

For the purpose of facilitating an understanding of the invention, the accompanying drawings and detailed description illustrate preferred embodiments thereof, from which the invention, its structures, its construction and operation, its processes, and many related advantages may be readily understood and appreciated.

DESCRIPTION OF THE EMBODIMENTS

The following description is provided to enable those skilled in the art to make and use the described embodiments set forth in the best mode contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

Figure 1:
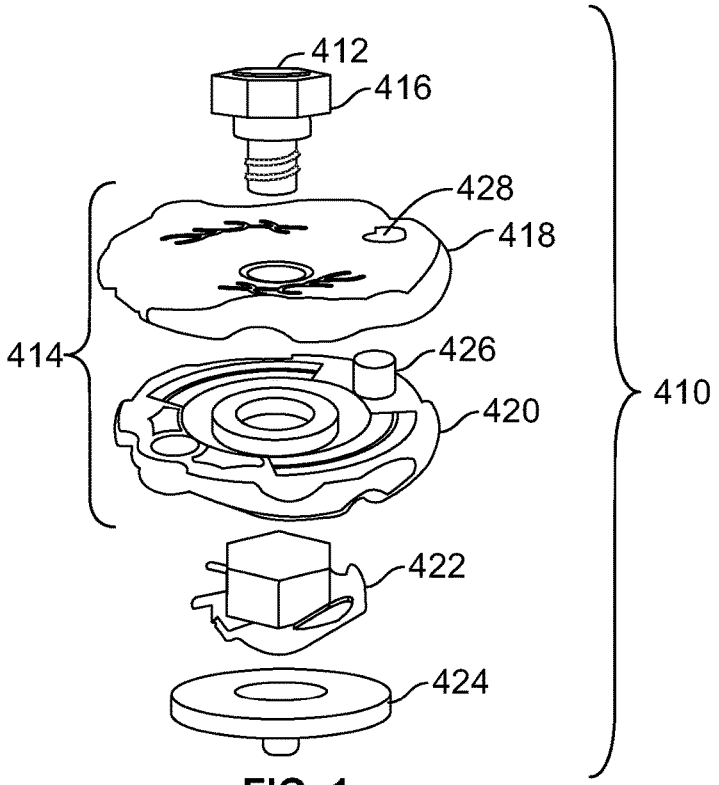
FIG. 1 shows an alternate embodiment exploded view of the physical toy top shown in FIG. 1A.
Figure 1A:
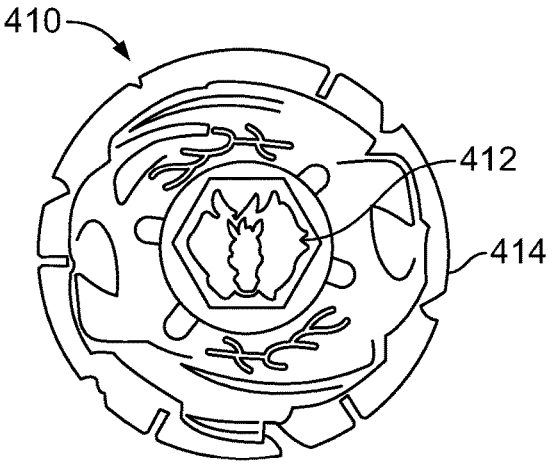
FIGS. 1A and 1B show exploded and top plan views of a physical toy top.

FIGS. 1 and 1A show views of a physical toy top. The physical toy top may be constructed from any material suitable for the top to withstand colliding with another top of the same or similar material spinning at a high rate. The physical top 410 embodies a particular spirit, or character, identified by the spirit/character symbol 412. The described embodiment allows for one to any number of spirit/character symbols 412 as long as each spirit/character symbol 412 is represented by a virtual spirit/character in the videogame app. The crown of the physical top 414 is the part of the spinning physical top 410 that collides with other spinning physical tops 410. Although the physical design of the crown of the physical top 414 shown is randomly and irregularly notched, any design suitable for fair competition between spinning tops may be used. The described embodiment has several designs and colors for the crown of the physical top 414 and provides for greater excitement and unpredictability in battles because of the greater number of possible collisions scenarios. Additionally, the part of the toy featuring the spirit/character symbol 412 may be separate and detachable from the part of the toy featuring the crown of the physical top 414, which may be detachable from the remainder of the physical top 410. Thus, the physical tops 410 in the described embodiments are extremely customizable.

Not shown in FIG. 1A, the physical top 410 has a BLE module or other wireless that may communicate a unique alphanumeric identification number to a BLE equipped electronic device. Thus, even if the two different physical tops 410 have the same spirit/character symbol 412 and the same crown of the physical top 414, each will be uniquely identifiable to a videogame application running on an BLE equipped electronic device. Other protocols besides BLE may be used.

Figure 1B:
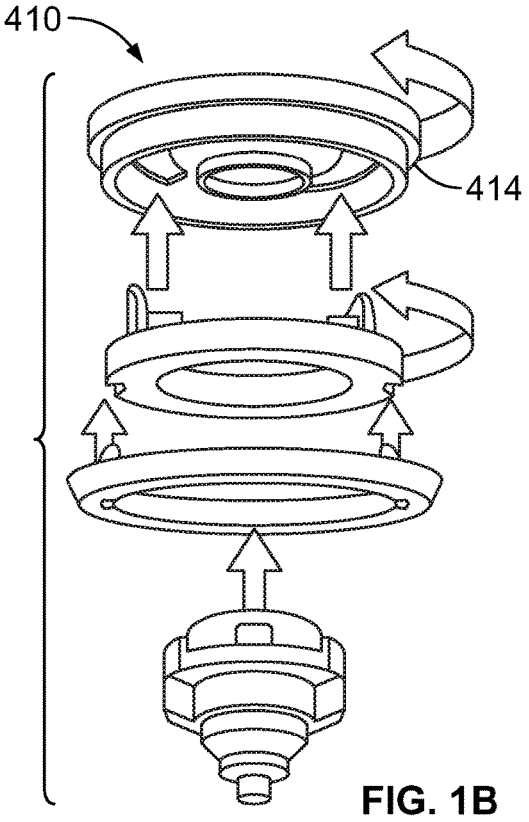

FIG. 1B shows an exploded view of the physical toy top shown in FIG. 1A. The crown nut 416 in the described embodiment is shown as a standard nut, which may be made of plastic, metal or any suitably durable material, although any design capable of attaching to a crown of the physical top 414 defined with reference to FIG. 1A may be used. The crown nut 416 contains the spirit/character symbol 412 described in FIG. 1A on its topside. The crown of the physical top 414 from FIG. 1A is shown as a two-piece design, although other designs may be used. The crown of the physical top 414 is composed of a crown battle shield 418 and a crown support 420 that attach to each other. FIG. 1A shows a configuration where a crown support post 416 on the crown support 420 fits snugly into a crown battle shield hole on the crown battle shield 418, although other configurations are possible. In the described embodiment, the physical top 410 may be customized by swapping one crown nut 416 with another and one crown battle shield 418 with another without dismantling the remainder of the physical top 410 for customization.

Also in the described embodiment, the crown nut 416, the crown battle shield 418 and the crown support 420 fit together to form a single piece, which are fully customizable and may appear in various forms. As shown further in FIG. 1B, the crown of the physical top 414 attaches to a point 424 with a BLE module 422 sandwiched between the crown of the physical top 414 and the point 424. Thus, the crown nut 416, the crown of the physical top 414, the BLE module 22, and the point 24 snap together to form the physical top 410. In the described embodiment, the BLE module 422 may be activated by a centrifugal switch so that spinning may be detected. In some games involving battle between tops, some tops will break apart after colliding with another top. A "broken" top may be considered out of the competition, and, thus, should not produce a BLE signal. Therefore, in the described embodiment, the BLE module 422 may additionally, or alternatively, be activated by an assembly contact switch that provides a closed circuit and a BLE signal when a physical top 414 is fully assembled and that provides an open circuit and no BLE signal when the physical top 414 has broken apart. Other activation means may be used.

Figure 2:
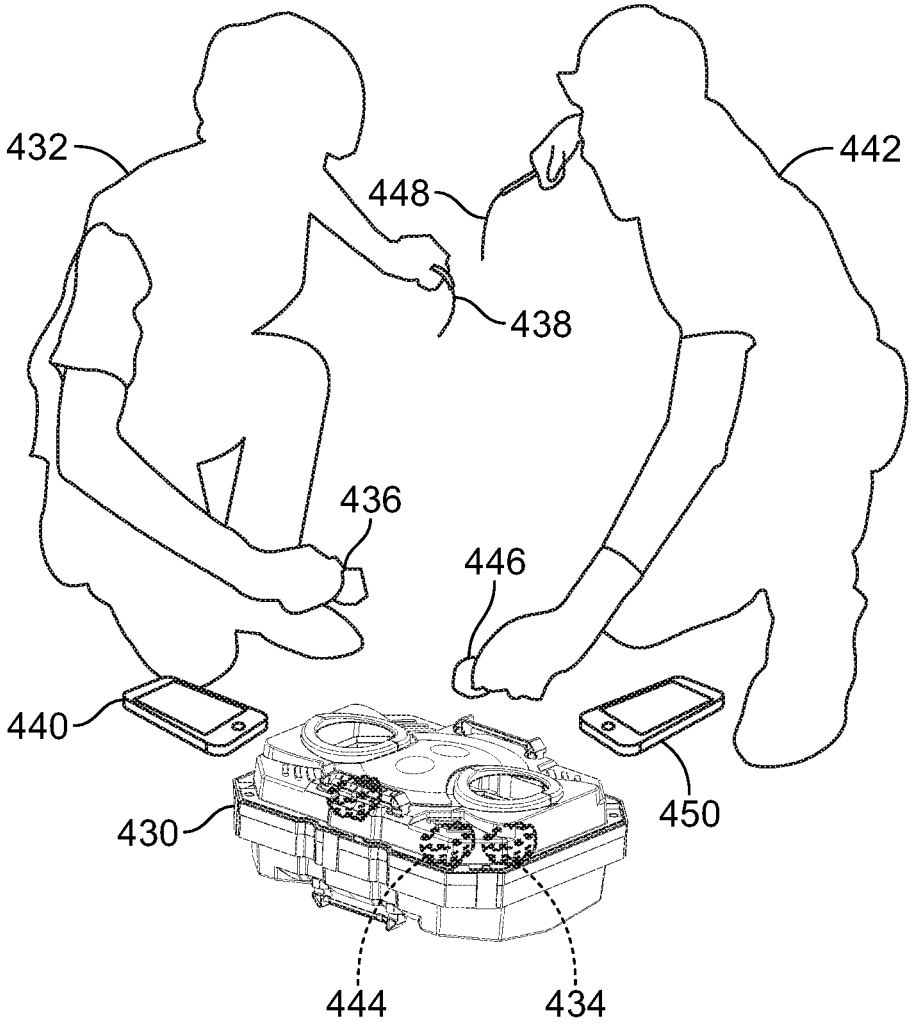
FIGS. 2 and 2A show perspective views of players, each with battling top devices, playing a battling game which may use two or four physical toy tops and a stadium-shaped game board arena.
Figure 2A:
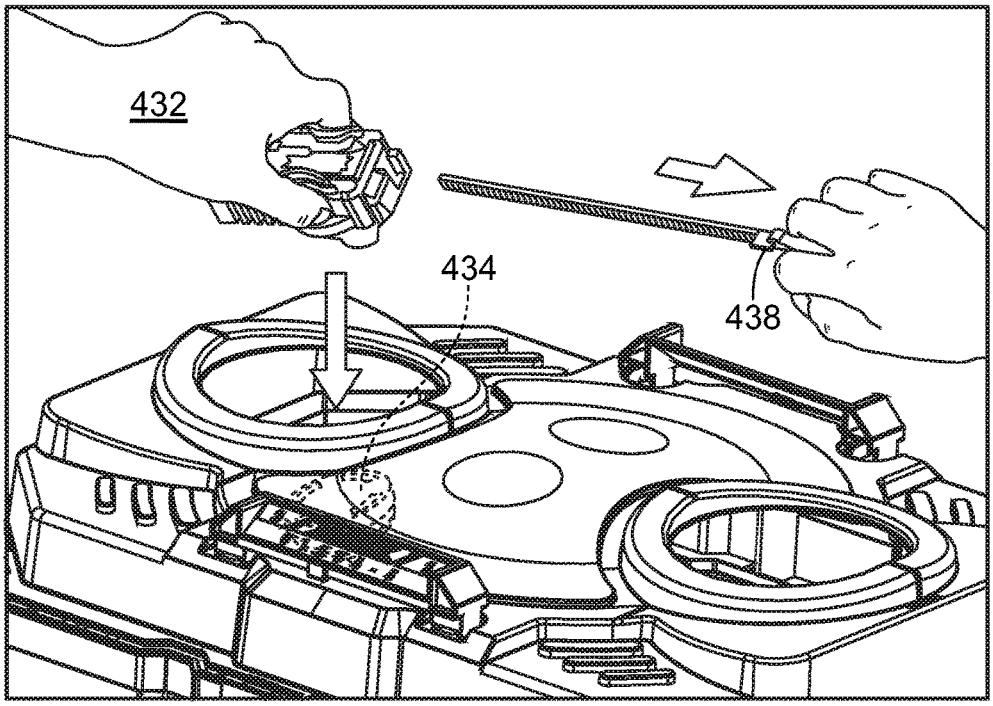

FIGS. 2 and 2A show perspective views of players, each with battling top devices, playing a battling game which may use two or four physical toy tops and a stadium-shaped game board arena. In the described embodiments, a battle using a multiplicity of physical toy tops occurs in a stadium-shaped game board 430. FIG. 2A shows that the first player 432 has spun one battling physical top 434, which is spinning in the stadium-shaped game board 430. The first player 432 is also shown holding a wound physical top 436, which has been wound using the ripcord 438 so that the wound physical top 436 is gyrating and will spin when placed on a the surface of the stadium-shaped game board 430. The first player's electronic device 440 sits in close proximity to the first player 432 so that the first player 432 may see and hear the videogame app running on the first player's electronic device 440.

Likewise, FIG. 2A shows that the second player 442 has spun one battling physical top 444, which is spinning in the stadium-shaped game board 430. The second player 442 is also shown holding a wound physical top 446, which has been wound using the ripcord 448 so that the wound physical top 446 is gyrating and will spin when placed on a the surface of the stadium-shaped game board 430. The second player's electronic device 450 sits in close proximity to the second player 442 so that the second player 442 may see and hear the videogame app running on the second player's electronic device 450. The stadium-shaped game board 430 may be further identified, uniquely identifiable, or redeemable either through digital connectivity, with a slip sheet insert, or using a communicated or printed code.

In scenarios like that in FIG. 2A, the battling physical top 434, the battling physical top 444, the wound physical top 436, the wound physical top 446, the stadium-shaped game board 430, the first player's electronic device 440 and the second player's electronic device 450 are all BLE equipped and are capable of recognizing each other, which may be subject to activation by registration in some described embodiments. Other protocols may be used. For example, the first player 432 has purchased the battling physical top 434 and the wound physical top 436 and registered them to an account associated with the first player 432 and a videogame app running on the first player's electronic device 440. Similarly, the second player 442 has purchased the battling physical top 444 and the wound physical top 446 and registered them to an account associated with the second player 442 and a videogame app running on the second player's electronic device 450.

In this example, because each BLE equipped physical top has a unique alphanumeric identification number that it communicates to each player's BLE equipped electronic devices, the videogame application on each player's electronic device may sense which battling physical tops belong to the player whose account is associated with that player's electronic device and which battling physical tops belong to the opposing player. Thus, the videogame application for a particular player may keep track of the opponents' identities against whom that particular player has battled. Each videogame application may further offer a user input interface to allow each player to enter who won each battle.

In some embodiments, as noted above, the BLE module in a physical top may be activated by a centrifugal switch so that spinning may be detected and/or an assembly contact switch so that a fully assembled top may be detected. In these embodiments, the videogame application on each player's electronic device may be programmed to know that a particular physical top has stopped spinning because the videogame application is no longer receiving the physical top's unique alphanumeric identification number because of rotation or because the physical top has broken apart. In these embodiments, the videogame application may automatically calculate who has won by the last top spinning, as well as calculate battle standings and related statistics. For purposes of the described embodiment, a physical top that has broken apart is no longer spinning.

It should be noted that FIG. 2A features physical tops that begin gyrating internally when energy is transferred to the top from a player pulling a ripcord. This configuration allows the player to hold a top that is gyrating internally and to place the top onto a surface so the top will spin without the top losing much energy. While this form of a physical top may be desirable in many embodiments, the described manner of spinning the top is not meant to be limiting, and other means of spinning the physical tops are possible, and means other than receiving BLE from spinning may be used, such as means using an assembly contact switch as described above.

Figure 2B:
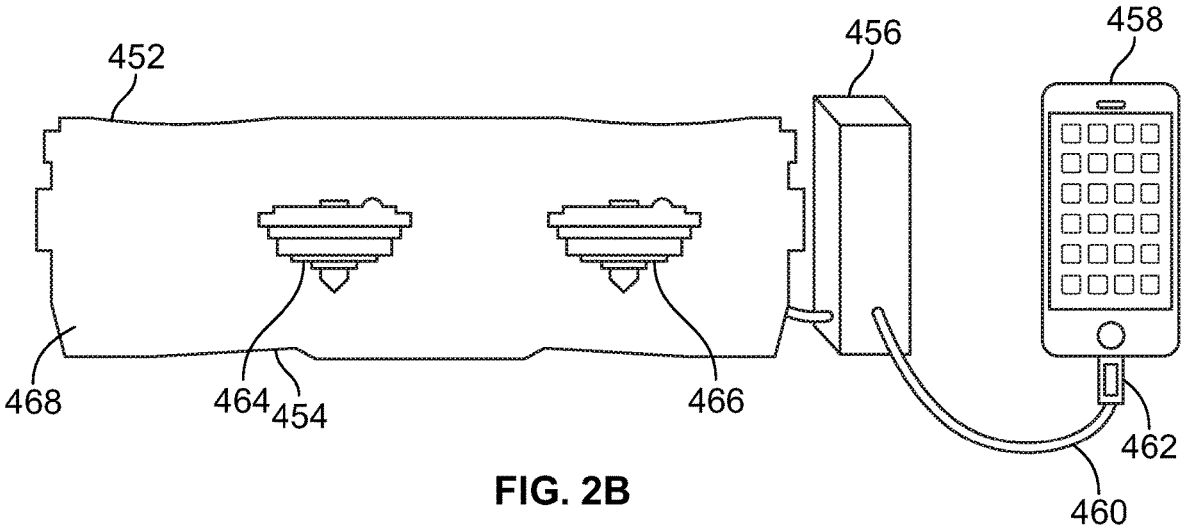
FIG. 2B shows a transparent plan view from the side of a stadium-shaped game board arena.

FIG. 2B shows a transparent plan view from the side of a stadium-shaped game board. In this particular embodiment, the battle arena is an BLE equipped stadium game board 452 with an BLE reader antenna 454 proximate the BLE equipped stadium game board 452 such that the BLE reader antenna 454 will detect a spinning top within the BLE equipped stadium game board 452. The stadium electronics 456 inputs signals from the BLE reader antenna 454 and receives the unique alphanumeric identifier only for tops within the BLE equipped stadium game board 452. In tops where a centrifugal switch enables an BLE read only for spinning tops, the stadium electronics 456 will start detecting spinning tops when placed within the BLE equipped stadium game board 452 and stop detecting a top when the top stops spinning within the BLE equipped stadium game board 452 or exits while spinning. In tops where an assembly contact switch enables a BLE read only for assembled tops, the stadium electronics 456 will start detecting assembled tops when placed within the BLE equipped stadium game board 452 and stop detecting a top when the top stops breaks apart within the BLE equipped stadium game board 452 or exits while spinning.

The stadium electronics 456 communicates in real time with a videogame app on an electronic device 458 by sending the unique alphanumeric identifiers of the tops spinning within the BLE equipped stadium game board 452 to the videogame app through a wired connection 460 plugged into the headphone jack 462 of the electronic device 458. Although this connection is shown as wired, wireless connections may also be used. This way, from real time data, the videogame app can determine the order in which the spinning tops stop and thus determine a winner and the finishing positions of all the competitors. For example, in FIG. 2B, the first player top 464 and the second player top 466 may be placed onto the stadium battling or game surface 468, where each top will spin and emit its unique alphanumeric identifier and continue to emit the identifier while spinning. Meanwhile, the data from the spinning tops will go through the stadium electronics sensor devices 456 to the personal electronic device 458 which is capable of detecting and monitoring the spinning tops on the battling or game surfaces, and communicating the spinning top activity to the videogame app on the personal electronic device of the user 458 and track the battle until all tops have stopped spinning. Alternatively to the wired connection shown in FIG. 2B, the electronic sensor devices 456 are capable of wirelessly communicating the spinning top activity to a personal electronic device of the user. Then, the videogame app will be able to determine the entire outcome of the battle, including the winner and the order in which the tops stopped. Additionally, the videogame app may manage statistics for all players and offer rewards to redeem either in the real world or in the virtual world. The statistics kept may also be transferred to the Cloud for storage, management, including rewards, and use across a network.

Figure 2C:
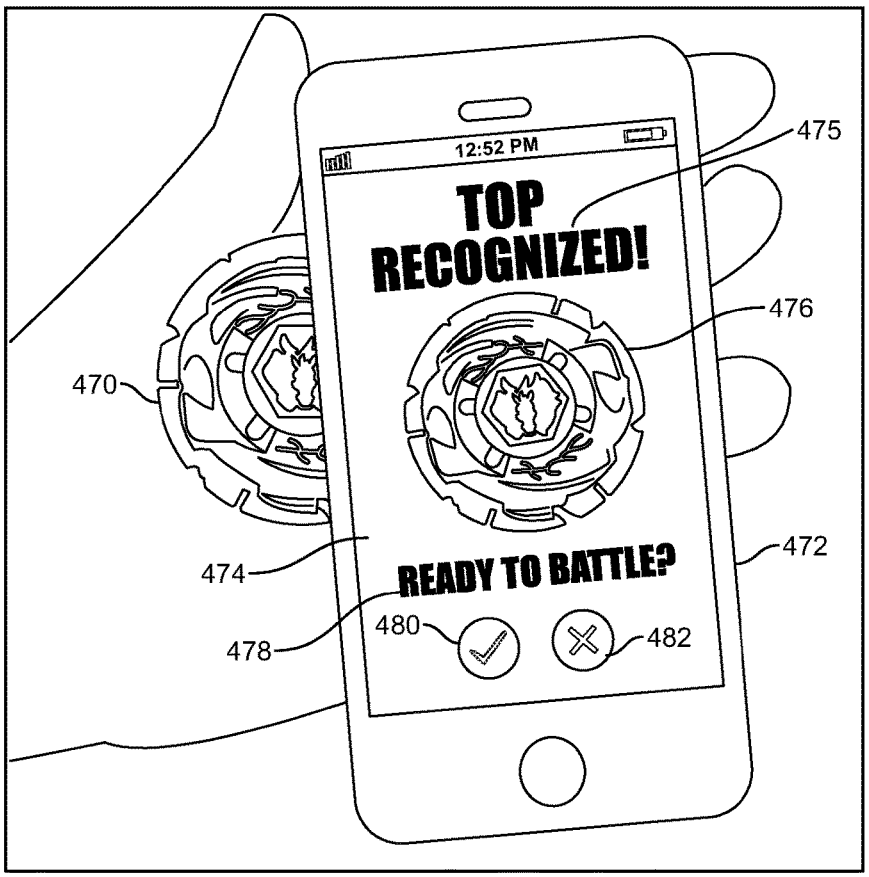
FIG. 2C shows physical toy top recognition on an electronic device when a player returns from playing a physical battle and goes to play a virtual battle.
Figure 2D:
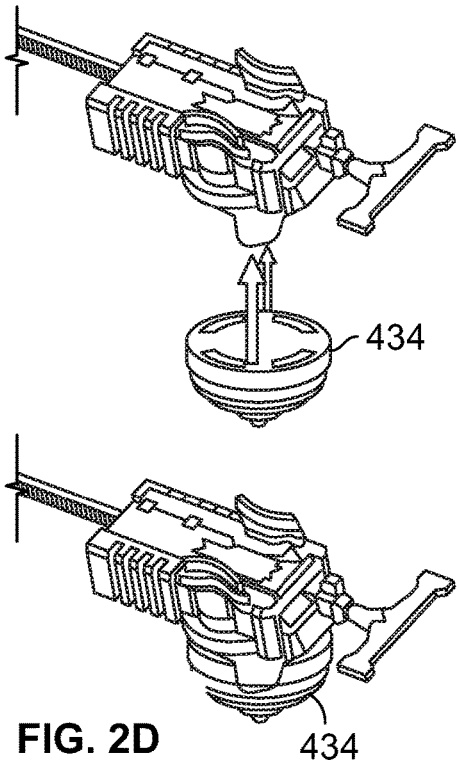
FIG. 2D is an isometric view of a battle top being loaded onto a launcher.

FIG. 2C shows physical toy top recognition on the electronic device when a player returns from playing a physical battle and goes to play a virtual battle. Once the players have finished the physical battle in the real world, they may return to battle in the virtual world by performing the tapping process described above. That is, each player may take his or her registered physical top 470, with the videogame app running on the electronic device 472, and tap the top on the video screen 474 of the electronic device 472. Because the player has registered the physical top 470, the videogame app recognizes the unique alphanumeric identification and displays a top recognition notice 475 and a recognized top image 476, which is shown as an image of the registered physical top 470 in FIG. 2C. At this point, the player has successfully transferred the Spirit back to the virtual environment. The player is also prompted with a virtual battle inquiry 478 asking the player if he or she wishes to battle in the virtual world. The player may select the virtual battle accept button 480 to play or the virtual battle decline button 482 not to play.

Figure 3:
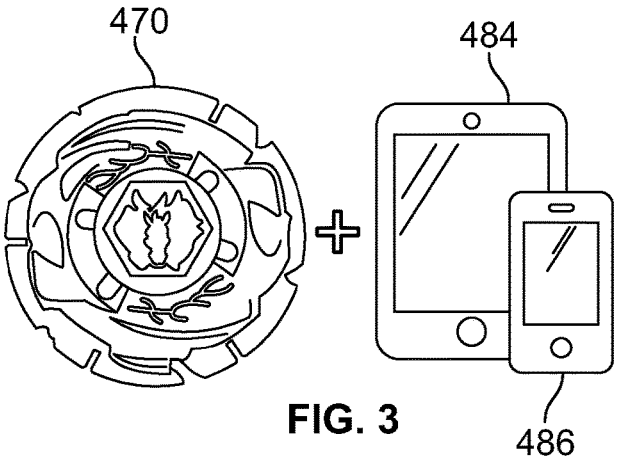
FIG. 3 shows how a player may register a physical top on more than one of the player's electronic devices in an integrated multi-environment game.

FIG. 3 shows how a player may register a physical top on more than one of the player's electronic devices in the integrated multi-environment game. In the described embodiments, a player who has a registered physical top 470 may use the registered physical top 470 on any capable electronic device that the player owns. As shown in FIG. 3, an integrated system may consist of a registered physical top 470, a first registered electronic device 484, and a second registered electronic device 486.

Figure 4:
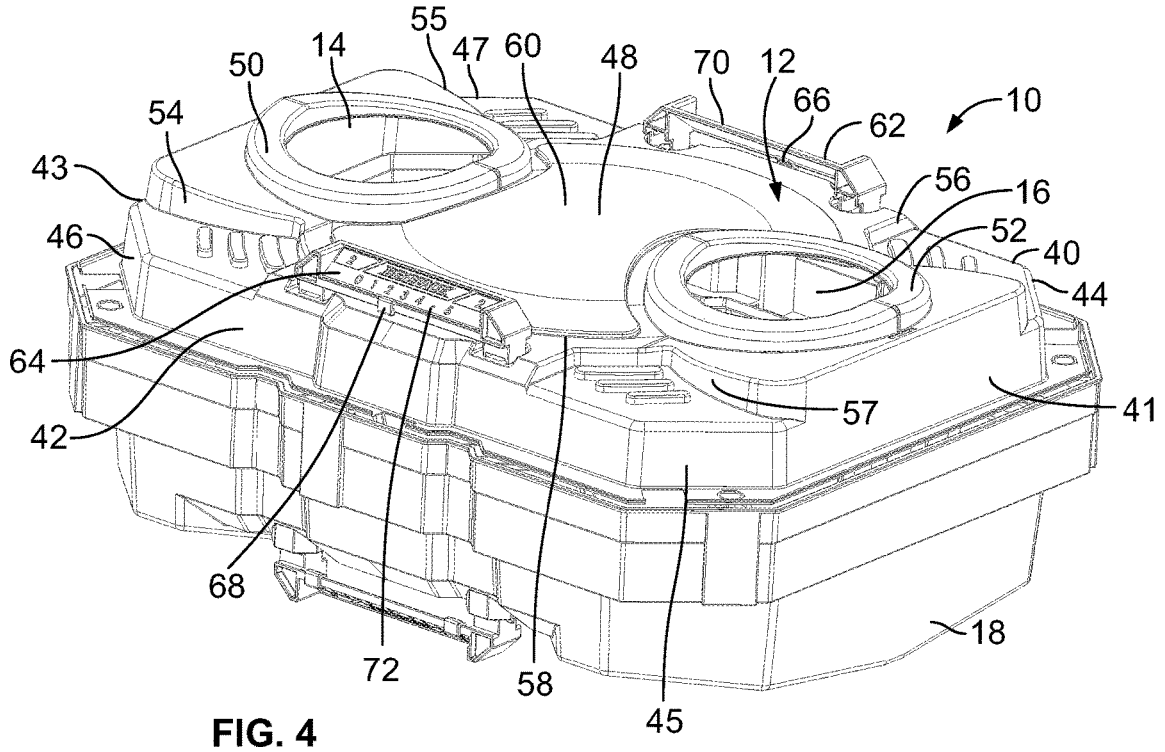
FIG. 4 is an isometric view of an embodiment of the present invention in the form of a battle arena apparatus for spinning battle tops, the apparatus is oriented for two players.
Figure 5:
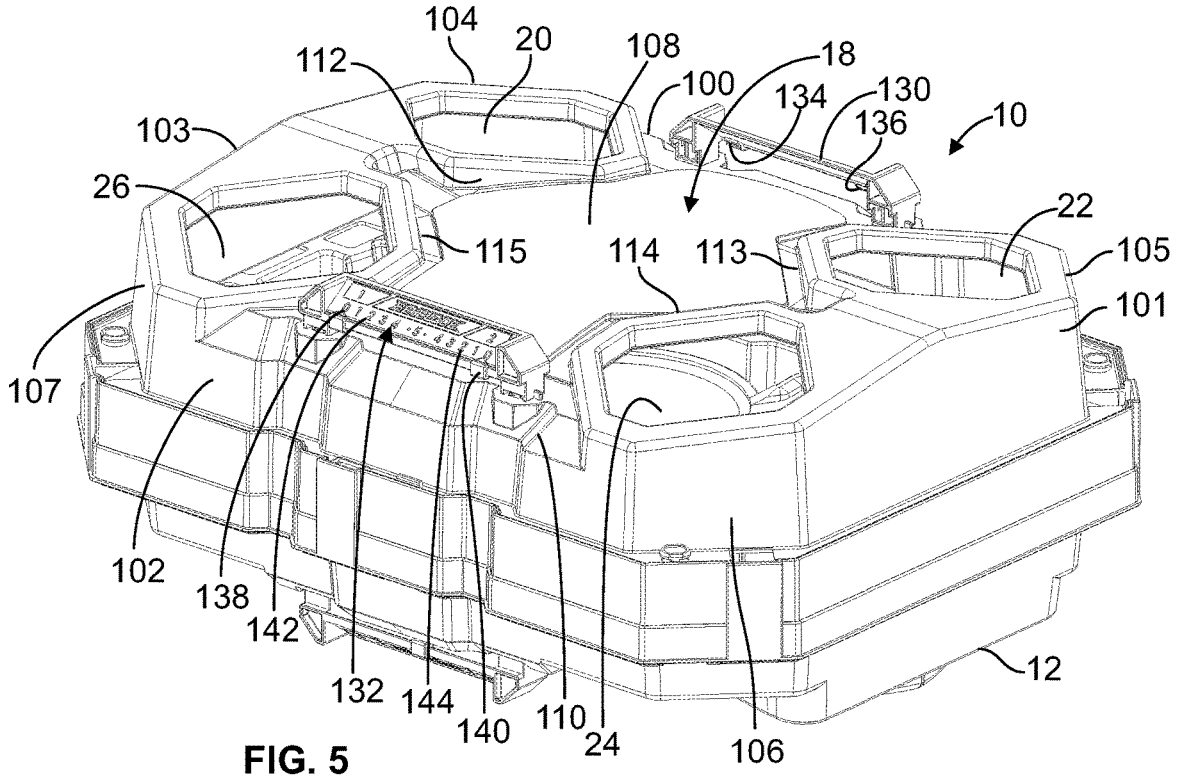
FIG. 5 is an isometric view of the battle arena apparatus shown in FIG. 4, but oriented for up to four players after being turned upside down.
Figure 6:
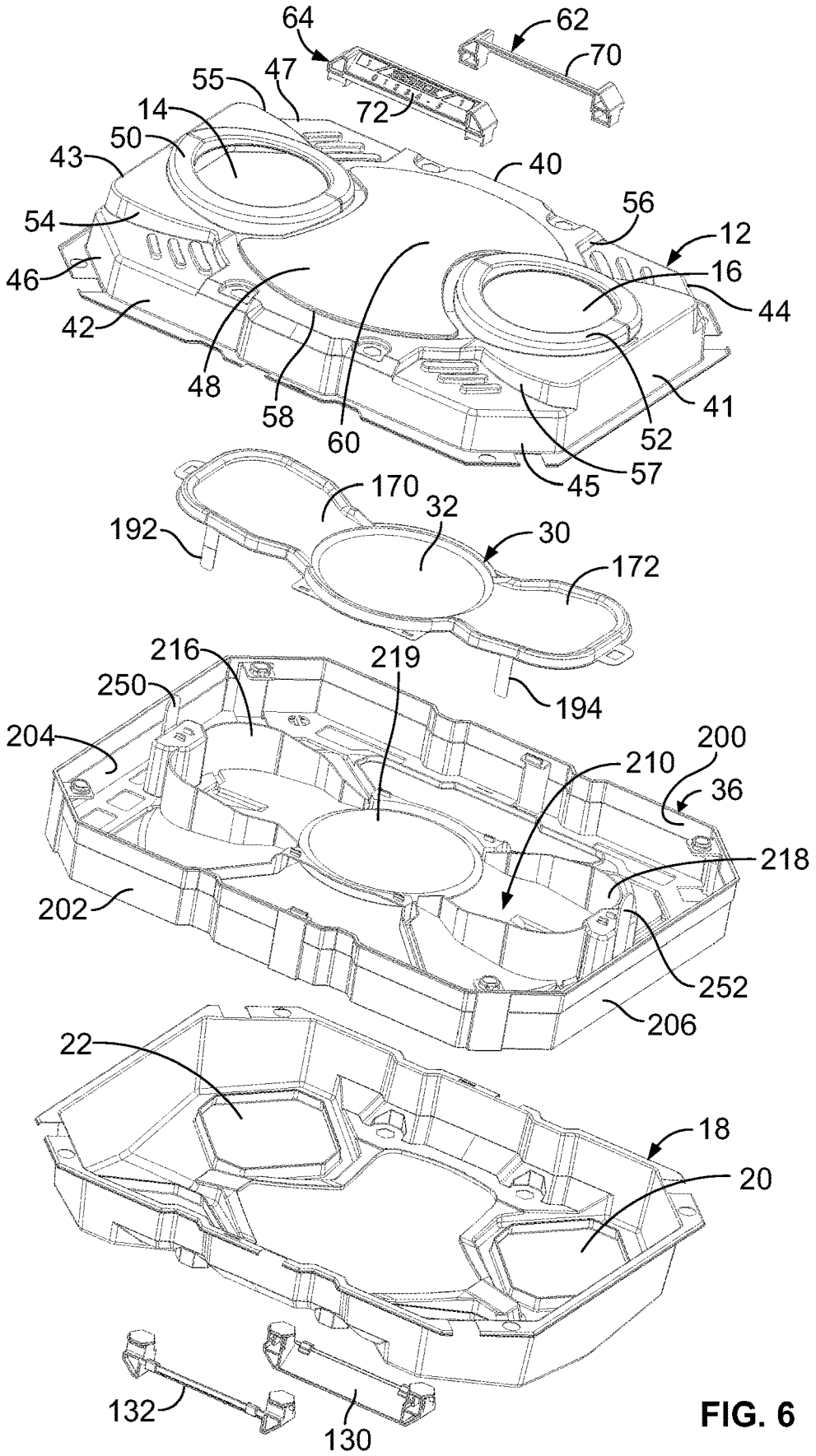
FIG. 6 is an exploded isometric view of the battle arena apparatus shown in FIGS. 4.

Referring now to FIGS. 4-6, there is illustrated an embodiment of the present invention in the form of a battle tower, stadium or battle game arena apparatus 10 that provides multiple surfaces for spinning battle tops to engage each other in combat. Battle tops of the type that may be used with the battle arena apparatus 10 are disclosed and expressly incorporated herein by reference for an "Integrated Multi Environment Interactive Battle Game" published on Feb. 4, 2016, US Patent Application Publication 2016/0030848, to Lema et al. The following Patent Application for a "Multi Sourced Point Accumulation Interactive Game" also filed on Feb. 4, 2016, US Patent Application No. 2016/0035178 to Judkins, et al. is also expressly incorporated herein by reference.

The battle game arena apparatus 10 is made very compact and lightweight for shipping and yet easy to assemble and use. The battle arena 10 is also reversible or may be flipped such that when placed in one orientation the battle arena is arranged for up to two players, as shown in FIG. 4, and when turned upside down to another orientation the battle arena is arranged for up to four players, as shown in FIG. 5. The battle arena 10 is formed of a rugged transparent plastic having a length of about seventeen and a half inches, a width of about fourteen inches and a height dimension of about seven and a half inches when assembled. However, before assembly and during shipment, the battle arena 10 may be less than about three and a half inches high, less than half of the assembled height and hence much more efficient for shipping. The battle arena has connectors/couplings and openings/couplings that allow for a nesting configuration that may easily be transformed to a game ready configuration.

The battle arena apparatus 10 includes as its main components a first lid 12, as seen in FIG. 4, having two opposing main openings or launch openings 14, 16, and a second lid 18, as seen in FIG. 5, having four main openings or launch openings 20, 22, 24, 26. The two launch openings of the first lid, enable two, or up to two players, to each insert a spinning battle top through a corresponding launch opening of the first lid. Similarly, the four launch openings of the second lid, enable up to four players to each insert a spinning battle top through a corresponding launch opening of the second lid.

The battle arena game apparatus 10 also includes a first base 30, as seen in FIG. 6, having a battling or game playing surface 32, to enable spinning battle tops inserted through the two launch openings of the first lid to engage each other in combat. A second base 36, also includes a battling or game playing surface 38 to enable spinning battle tops inserted through the four launch openings in the second lid to engage each other in combat. The battling or game playing surface 38 of the second base is positioned juxtaposed to the second lid 18. The second base 36 also includes a support surface 210 for mounting the first base 30, with the first base being mounted juxtaposed to the first lid 12. Both of the battling or game playing surfaces 32, 38 give the appearance of being suspended between the lids 12, 18 when the arena is in play mode. The second base 36 mounts the first and second lids, with the second base including a first side and a second side and a clam shell coupling mounting the first lid to the first side of the second base and a clam shell coupling mounting the second lid to the second side of the second base. The lids 12, 18 and bases 30, 36 are easily assembled by attaching each of the lids 12, 18 and the first base 30 to the second base 36, as will be described in greater detail below.

The first lid 12 is formed of transparent plastic with the two large launch openings 14, 16 to enable two players to each insert or drop a spinning battle top through a respective opening as indicated in FIG. 2A, such that a battle is able to occur on the game surface 32 of the first base 30. Each of the main openings 14, 16 may have a diameter of about four inches. The first lid 12, FIGS. 4, 6 and 7, has a generally upside down pan-shaped configuration with four sidewalls 40, 41, 42, 43, four beveled corners 44, 45, 46, 47, and a top surface 48. The top surface includes a raised ring 50, 52 positioned around a corresponding opening 14, 16. The top surface 48 also includes strengthening levels 54, 55, 56, 57, 58 near the corners 44, 45, 46, 47 and around a center region 60. A handle 62, 64 is connected along each side of the lid and a pointer 66, 68 is attached to each of the handles. The handles 62, 64 make handling of the battle arena 10 convenient, function as supports when the first lid 12 is at the bottom of the battle arena as shown in FIG. 5, and serve as scoreboards 70, 72 for the two players.

Figure 7:
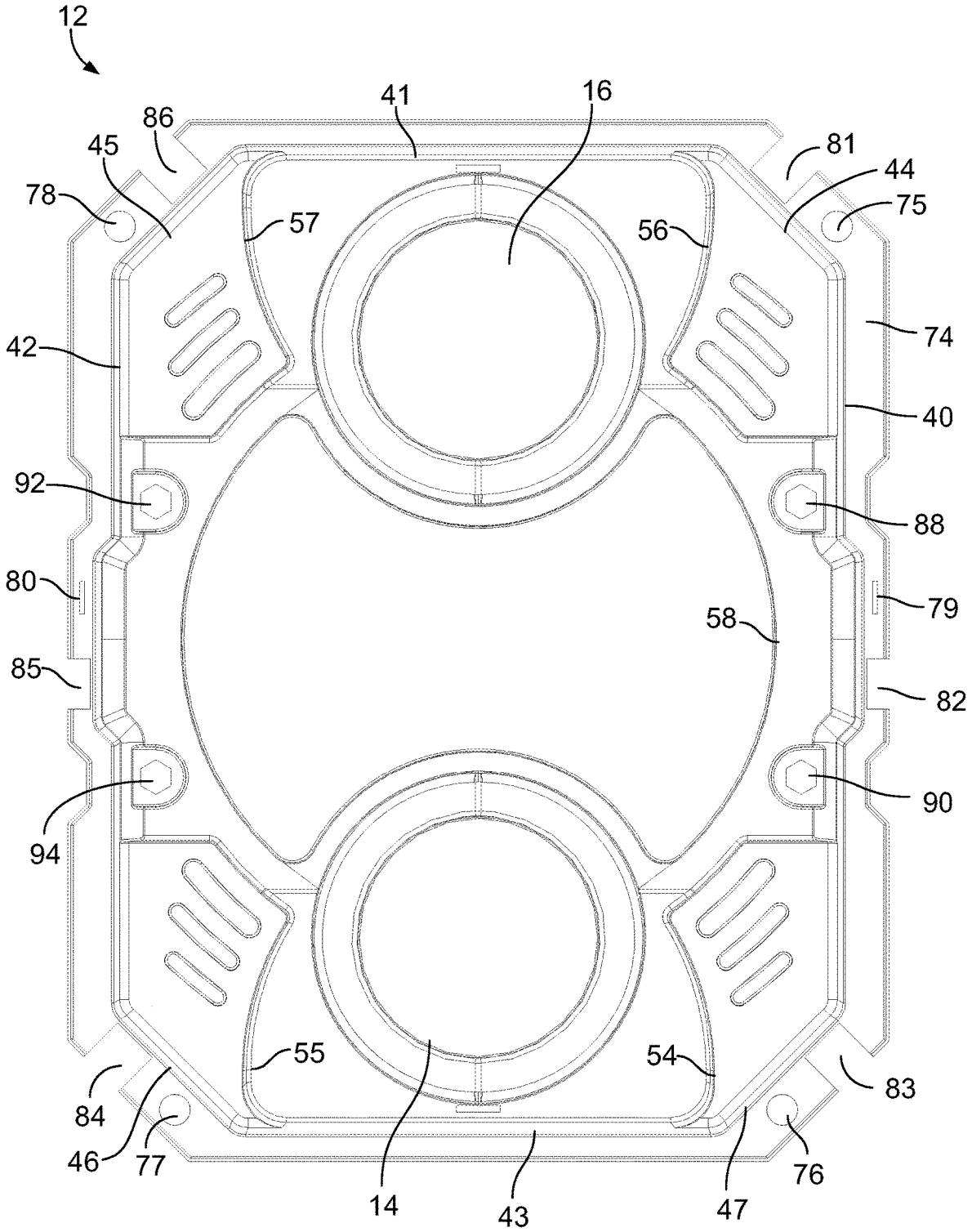
FIG. 7 is a bottom plan view of a first lid or first clam shell housing of the battle arena apparatus shown in FIGS. 4-6.

The first lid 12 also includes a peripheral flange 74, FIG. 7, with a clam shell coupling having four round connector openings 75, 76, 77, 78 and two rectangular connector openings 79, 80 for receiving a mating clam shell coupling including projecting generally round and rectangular finger and hook clip connectors formed with and on the second base 36. The peripheral flange 74 also includes six oversize rectangular openings 81, 82, 83, 84, 85, 86 for accommodating the second base 36 during shipment and prior to assembly of the battle arena 10. Two hexagon shaped openings 88, 90 are provided for attachment of the handle 62 and two hexagon shaped openings 92, 94 are provided for attachment of the handle 64. When the first lid 12 is oriented in one mode, it may be attached to the second base 36. However when the first lid is pivoted 180° the connectors are accommodated by the oversize openings and attachment of the first lid to the second base is avoided.

Figure 8:
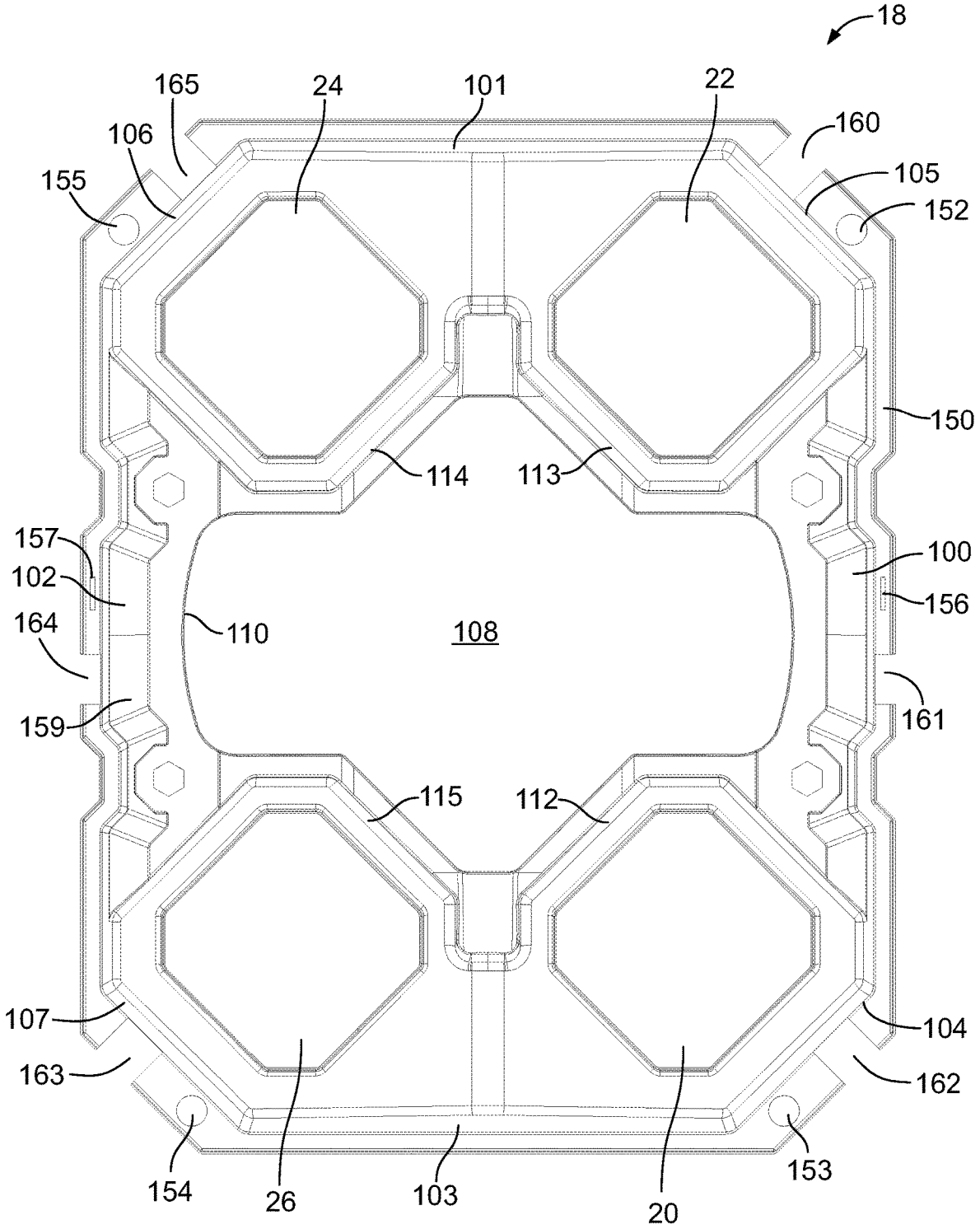
FIG. 8 is a bottom plan view of a second lid or second clam shell housing of the battle arena apparatus shown in FIGS. 4-6.
Figure 11:
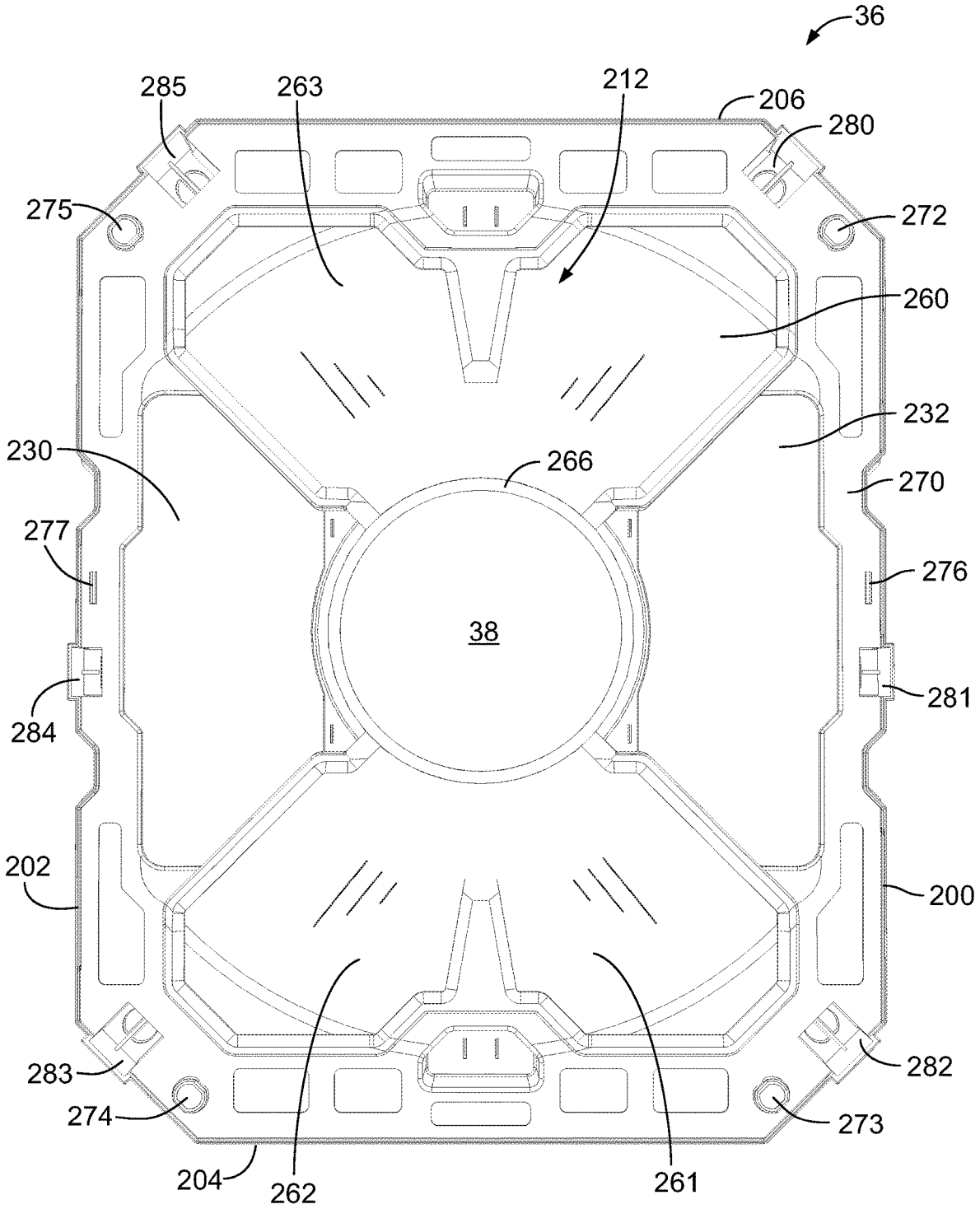
FIG. 11 is a battling surface of a second base or a second side of a base unit of the battle arena apparatus shown in FIG. 10.

The second lid 18, FIGS. 5, 6 and 8, with the four large launch openings 20, 22, 24, 26 enables up to four players to each insert or drop a spinning battle top through a respective opening so that combat of up to four tops is able to be played on the battling or game playing surface 38, FIG. 11, of the second base 36. Each of the main openings 20, 22, 24, 26 may be generally square shaped with beveled corners and have a dimension of about three and three-quarters inches across. The second lid 18, similar to the first lid 12, has a generally upside down pan-shaped configuration with four sidewalls 100, 101, 102, 103, four beveled corners 104, 105, 106, 107, and a top surface 108 with a border 110. The second lid 18 also includes partial borders 112, 113, 114, 115 around corresponding main openings 20, 22, 24, 26 for strengthening the second lid. Two handles 130, 132 are connected along each side of the second lid 18 and two pointers 134, 136 and 138, 140 are attached to each of the handles. The handles 130, 132 make handling the battle arena 10 convenient, provide a support when the second lid 18 is lowermost as shown in FIG. 4, and serve as scoreboards, with two scoreboards 142, 144 on each handle as illustrated on the handle 132 in FIG. 5.

The second lid 18 also includes a peripheral flange 150, FIG. 8, with a clam shell coupling having four round openings 152, 153, 154, 155 and two rectangular openings 156, 157 for receiving corresponding clam shell coupling of round and clip connectors extending from the second base 36. The flange 150 also includes six oversize rectangular openings 160, 161, 162, 163, 164, 165 for accommodating the connectors of the second base 36 during shipment and prior to assembly. Like the first lid, the second lid includes hexagon shaped openings for attaching the handles.

In the alternative, the first and second lids 12, 18 may be transparent only around the centers of the top surfaces 48, 108 to allow the battle tops to be viewed by the players from above. The lids may have decals on their sidewalls and portions of their top surfaces. Also in the alternative, the main openings may be larger or smaller as a function of the sizes of battle tops being used.

Figure 9:
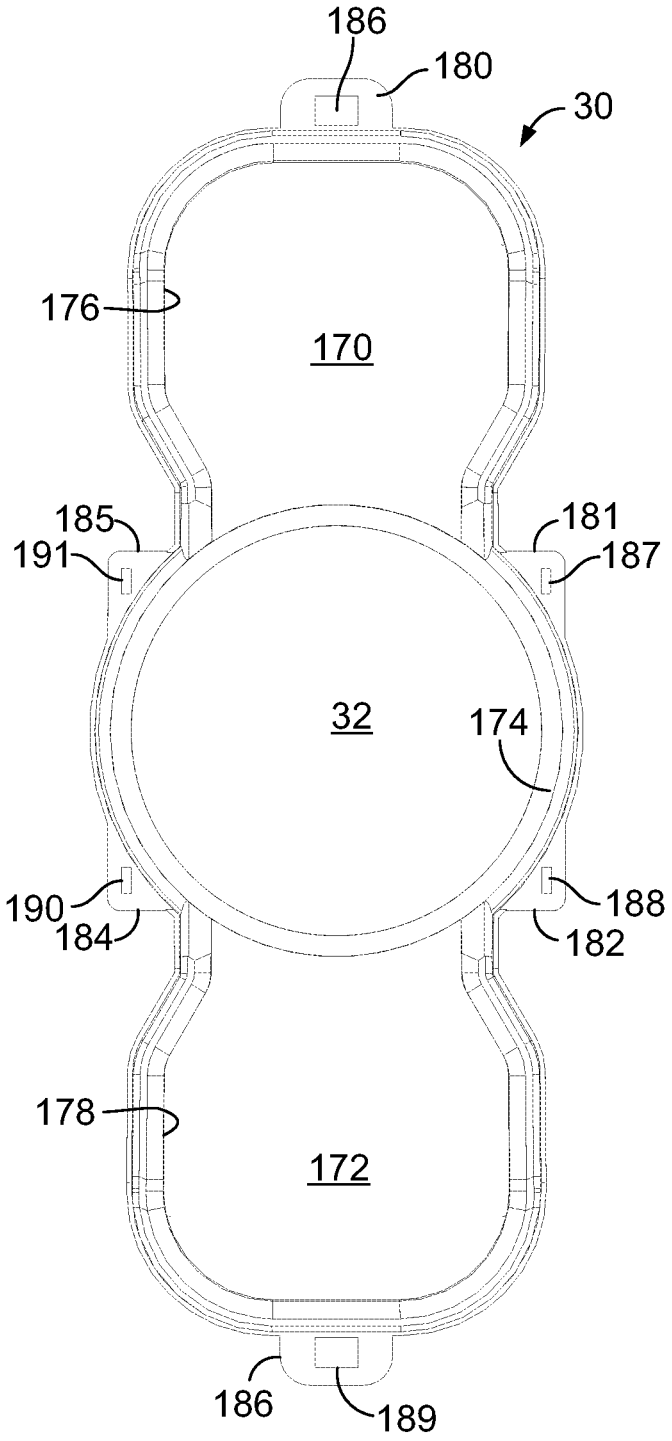
FIG. 9 is a top plan view of a first base and first battling surface of the battle arena apparatus shown in FIGS. 4-6.

The first base 30, FIGS. 6 and 9, is mounted to the second base 36 to work with the first lid 12. As shown in FIG. 6, the base 30 is located beneath the first lid when the arena is assembled. The first base 30 is relatively narrow and includes the centrally located battling surface 32 flanked by a pair of opposed slanted slide regions 170, 172. The slide regions are mounted juxtaposed the two launch openings of the first lid, with slide region 170 located beneath the launch openings 14 and the slide region 172 located beneath the launch opening 16 when the arena is assembled. The slide regions 170 and 172 are slanted toward the battling surface of the first base for directing spinning tops from the launch openings 14 and 16 to the battling surface 32. The angle of the slide regions from a horizontal reference may be about 5°.

The battling surface 32 is circular and includes a circular wall 174 at least partially forming a raised perimeter around the battling surface. The battling surface has a diameter of about five and a quarter inches, and the circular wall 174 has a height of about one-eighth of an inch. The battle arena, in combination with one or more spinning toy tops, each top having a tip suitable for gliding down the slide regions from the launch openings to battle at the battling surface, and are prevented by the circular wall from reentering the slide regions from the battling surface to create a one way flow of the one or more tops from the openings to the battling surface to maximize collisions between actively spinning tops at the battling surface.

The battle tops may engage each other in combat by colliding with each other on the battling surface 32 until only one top remains spinning and thus is the winner. The battle of the tops may be viewed through the top and sides of the first lid 12 and may appear to be suspended when the battle arena is transparent. Short walls 176, 178 may also border the slide regions 170, 172. The first base 30 also includes six flange tabs 180, 181, 182, 183, 184, 185 having six rectangular openings 186, 187, 188, 189, 190, 191 for receiving clip connectors mounted on the second base 36 and two guide tabs 192, 194, FIG. 6, may depend from the first base 30. The first and second lids 12, 18 and the first base 30 may be formed of any suitable plastic.

Figure 10:
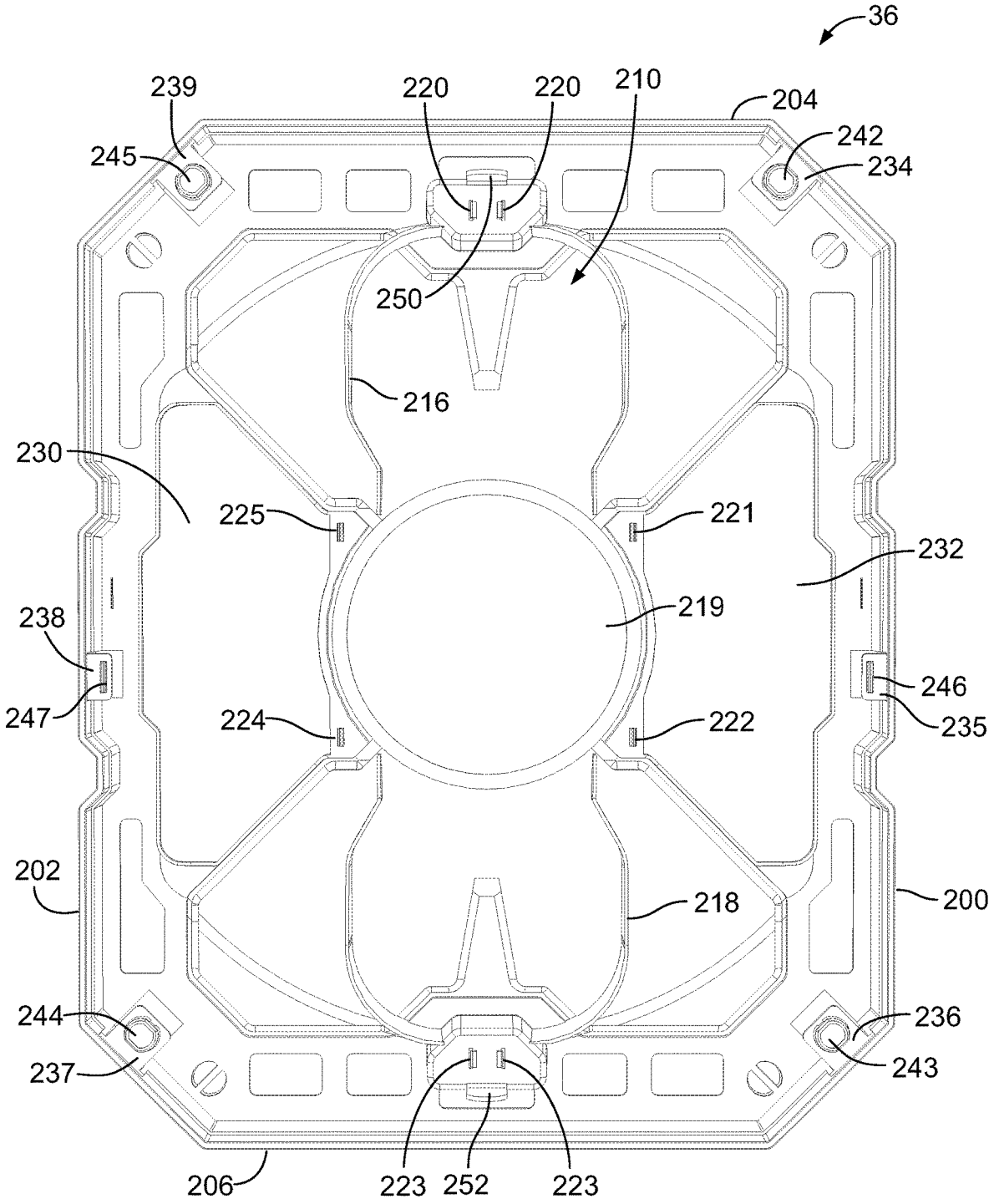
FIG. 10 is a support surface of a second base or a first side of a base unit of the battle arena apparatus shown in FIGS. 4-6.

The second base 36, FIGS. 6, 10 and 11, mounts the first base 30 and attaches to the first and second lids 12, 18 to form the assembled arena shown in FIGS. 4 and 5. The second base 36 may be formed of a more rigid plastic than the lids and the first base, and includes two long sides 200, 202 and two short sides 204, 206 that may have the same dimensions as the first and second lids. Between the sides 200, 202, 204, 206 extends a game surface 212, and a support surface 210 facing and acting with the first lid 12 with the game surface 212 facing and acting with the second lid 18.

The support surface 210, as seen in FIG. 10, includes two U-shaped interior walls 216, 218 for supporting the first base 30 and a central panel 219 (the opposite side of the battling surface 38) for supporting the battling surface 32 of the first base 30. The support surface 210 includes six upstanding finger and hook or clip connectors 220, 221, 222, 223, 224, 225 for being received in corresponding openings 186, 187, 188, 189, 190, 191 in the first base 30 that attach the first base 30 to the second base 36.

To either side of the central panel 219 are two large trapezoidal openings 230, 232 and around the edges of the second base is a clam shell coupling including six tabs 234, 235, 236, 237, 238, 239 for supporting six upstanding connectors, four round connectors 242, 243, 244, 245 to be received in corresponding clam shell coupling including openings 75, 76, 77, 78 of the first lid 12 and two clip connectors 246, 247 for receipt by corresponding openings 79, 80 in the first lid 12, for coupling the first lid to the first side of the second base. Two upstanding tabs 250, 252, FIG. 6, are mounted adjacent the connectors 220, 223 respectively.

The game surface 212, as seen in FIG. 11, of the second base 36 includes two pairs of opposed slanted slide regions flanking the battling surface 38 of the second base and mounted juxtaposed the four launch openings of the second lid. The two pairs of opposed slanted slide regions includes four slanted slide regions 260, 261, 262, 263, located beneath a corresponding one of the four main openings 20, 22, 24, 26 of the second lid 18 when the arena is assembled. The four slide regions 260, 261, 262, 263 are slanted toward a battling surface for directing spinning tops from the launch openings to a battling surface. The angle of each of the slide regions from a horizontal reference may be about 5°. The four slide regions function to direct battle tops dropped through the four openings 20, 22, 24, 26 to slide downward to the battling surface 38.

The battling surface 38 is circular and includes a circular wall 266 at least partially forming a raised perimeter around the battling surface. The short circular wall 266 may have a height of about one-eighth of an inch and the battle surface 38 may have a diameter of about a five and a quarter inches. Up to four battle tops may engage each other in combat on the battle surface 38 and the winner of the combat is the last top still spinning. The circular wall at least partially forming a raised perimeter around each of the battling surfaces prevents spinning tops from exiting the battling surfaces to maximize the frequency of collisions between actively spinning tops for enhanced game play and fun for the user.

In summary, the battle arena game apparatus includes multiple launch openings and slide regions for guiding spinning toy battle tops to flow one way from the launch openings toward the battling surfaces for engaging the tops in combat. The arena, in combination with one or more spinning toy tops, each top having a tip suitable for gliding down the slide regions from the launch openings to battle at the battling surfaces, and prevented by the circular wall from reentering the slide regions from the battling surfaces to create a one way flow of the one or more tops from the openings to the battling surfaces to maximize collisions between actively spinning tops at the battling surfaces.

Alternatively, the battle arena game apparatus can be described as a clam shell battle arena game apparatus 10 enabling two and four player orientations and including a first clam shell housing 12 having two launch openings 14 & 16 to enable up to two players to each insert a spinning battle top through a corresponding launch opening of the first clam shell housing. A second clam shell housing 18 having four launch openings 20, 22, 24, 26, enable up to four players to each insert a spinning battle top through a corresponding launch opening of the second clam shell housing, and a base unit 36 having a first side 210 and a second side 212, couples to the first clam shell housing at the first side and the second clam shell housing at the second side. A first battling surface 32 at the first side of the base unit enables spinning battle tops inserted through the two launch openings of the first clam shell opening to engage each other in combat, and a second battling surface 38 at the second side of the base unit enables spinning battle tops inserted through the launch openings in the second clam shell housing to engage each other in combat.

As seen in FIGS. 4 & 5, the base unit 36 containing first and second battling surfaces 32 and 36, respectively, is sandwiched between first and second clam shell housings, 12 & 18, respectively. The first and second battling surfaces 32 & 38, further include a circular wall at least partially forming a raised perimeter around each of the battling surfaces. A pair of opposed slanted slide regions 170 & 172 flank the first battling surface 32 and are mounted juxtaposed the two launch openings of the first clam shell housing when the arena is sandwiched together. Likewise, two pairs of opposed slanted slide regions, (260 & 262) & (261 & 263) flank the second battling surface 38 are mounted juxtaposed the four launch openings of the second clam shell housing when the arena is sandwiched together.

The slide regions are all slanted toward a battling surface for directing spinning tops from the launch openings to a battling surface. The clam shell battle arena, in combination with one or more spinning toy tops, each top having a tip suitable for gliding down the slide regions from the launch openings to battle at the battling surfaces, and prevented by the circular wall from reentering the slide regions from the battling surfaces to create a one way flow of the one or more tops from the openings to the battling surfaces to maximize collisions between actively spinning tops at the battling surfaces. Additionally, includes is one or more electronic sensor devices capable of detecting and monitoring spinning tops on the battling surfaces and wirelessly communicating the spinning top activity to a personal electronic device of a us The game surface/second side 212 of the second base 36 also includes a peripheral rim 270 including the clam shell coupling having six connectors, four generally round connectors 272, 273, 274, 275 that are received by the corresponding clam shell coupling including openings 152, 153, 154, 155 in the second lid 18. Two clip type connectors 276, 277 are for receipt in corresponding openings 156, 157. Peripheral rectangular openings 280, 281, 282, 283, 284, 285 may be used to facilitate shipping.

The rectangular openings 81, 82, 83, 84, 85, 86, FIG. 7, in the first lid 12 and the rectangular openings 160, 161, 162, 163, 164, 165, 166, FIG. 8, in the second lid 18 are provided for ease of packaging. The rectangular openings are placed to allow the lids 12, 18 and the bases 30, 36 to be nested but not yet attached.

In operation of the battle arena apparatus 10, the apparatus is nested for shipment and must be unpacked and easily assembled by a user. The first base 30 is snapped into place on the game surface 210 of the second base 36, the pointers 66, 68 are attached to corresponding handles 62, 64, and the handles 62, 64 are then connected to the first lid 12. The pointers 134, 136, 140, 142 are attached to the corresponding handles 130, 132 and the handles 130, 132 are connected to the second lid 18. The first lid 12 may then be attached to the connectors 242, 243, 244, 245, 246, 247, 248 on the periphery tabs of the second base 36 and the second lid 18 may be attached to the connectors 272, 273, 274, 275, 276, 277 of the second base 36. After assembly, the battle arena apparatus is ready for play. When there are two players, the battle arena 10 is oriented (as shown in FIG. 4) with the first lid 12 facing the players, and the second lid 18 is resting on a table, floor or other convenient support surface. When there are up to four players, the battle arena 10 is flipped or turned upside down so that the second lid 18 is facing the players (as shown in FIG. 5) and the first lid 12 is lowermost and resting on the support surface.

In use of the battle arena 10, each player may assemble his/her battle top, where each top may have its own characteristics, and each player may use a ripcord to cause the top to spin. The top is placed over one of the main openings in the first or second lids 12, 18 that has been assigned to that player and the spinning top is dropped onto the main opening. The winner of a battle may then move his/her pointer on a corresponding handle to keep score.

Figure 12:
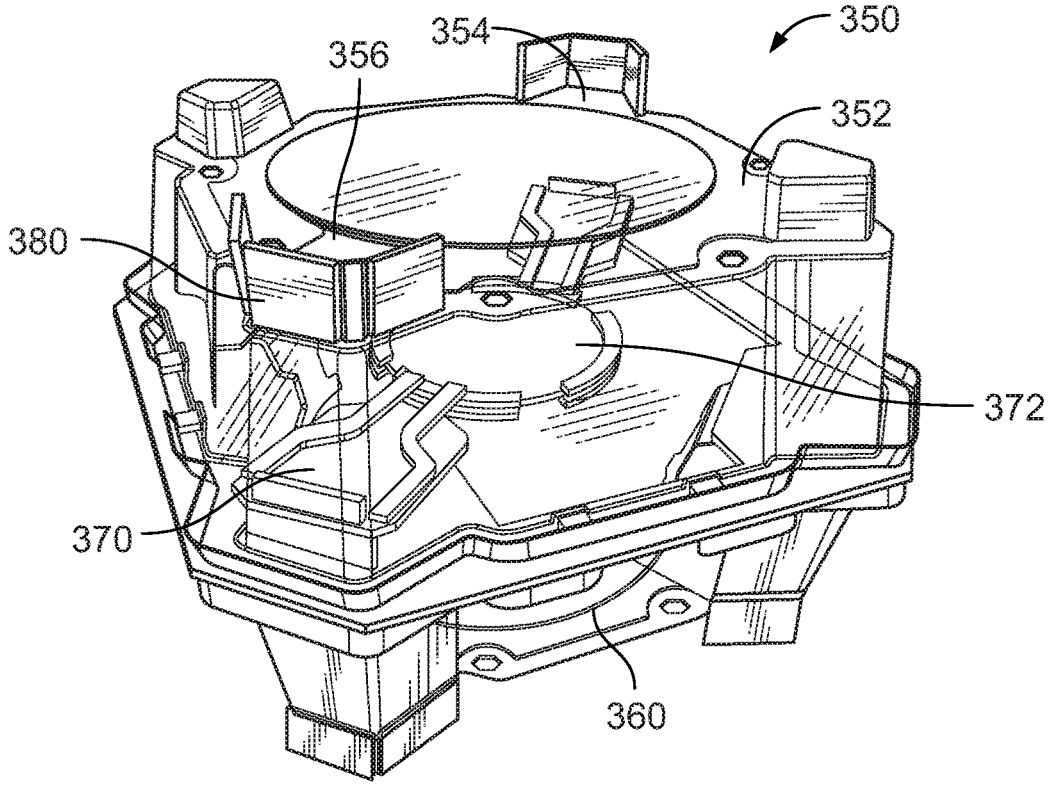
FIG. 12 is an isometric view of another embodiment in the form of a battle arena apparatus for spinning battle tops, the apparatus oriented for up to two players.
Figure 13:
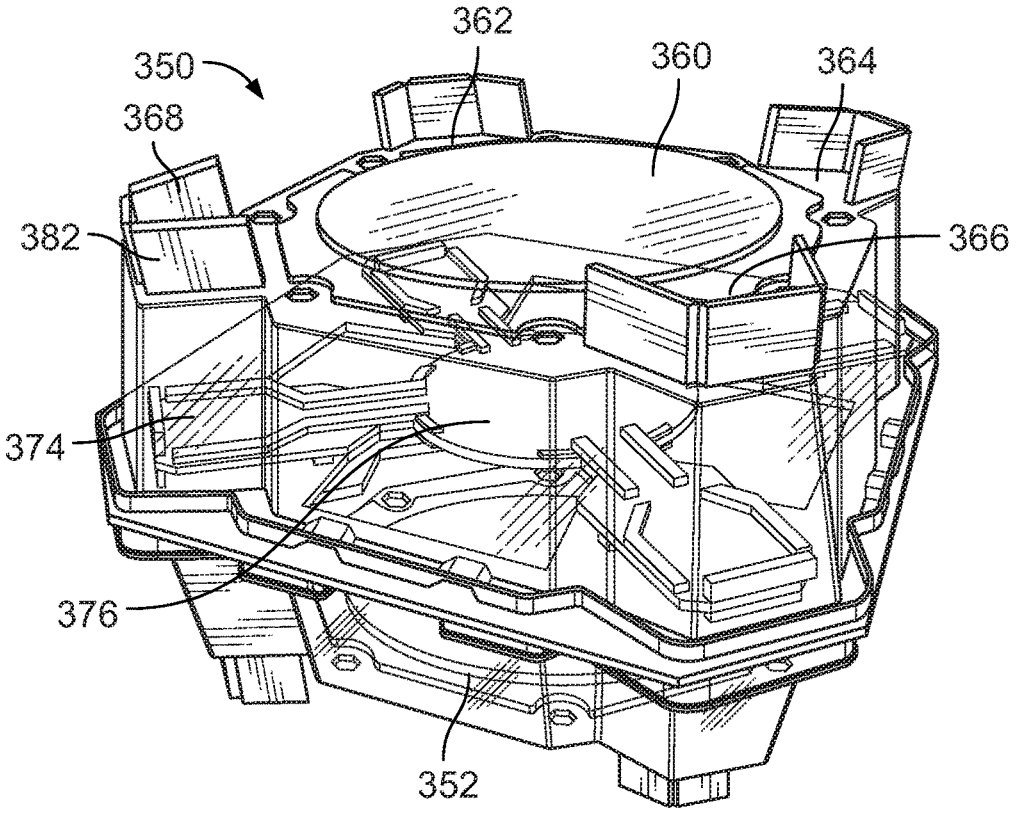
FIG. 13 is an isometric view of the battle arena apparatus shown in FIG. 12, but oriented for up to four players after being turned upside down.
Figure 14:
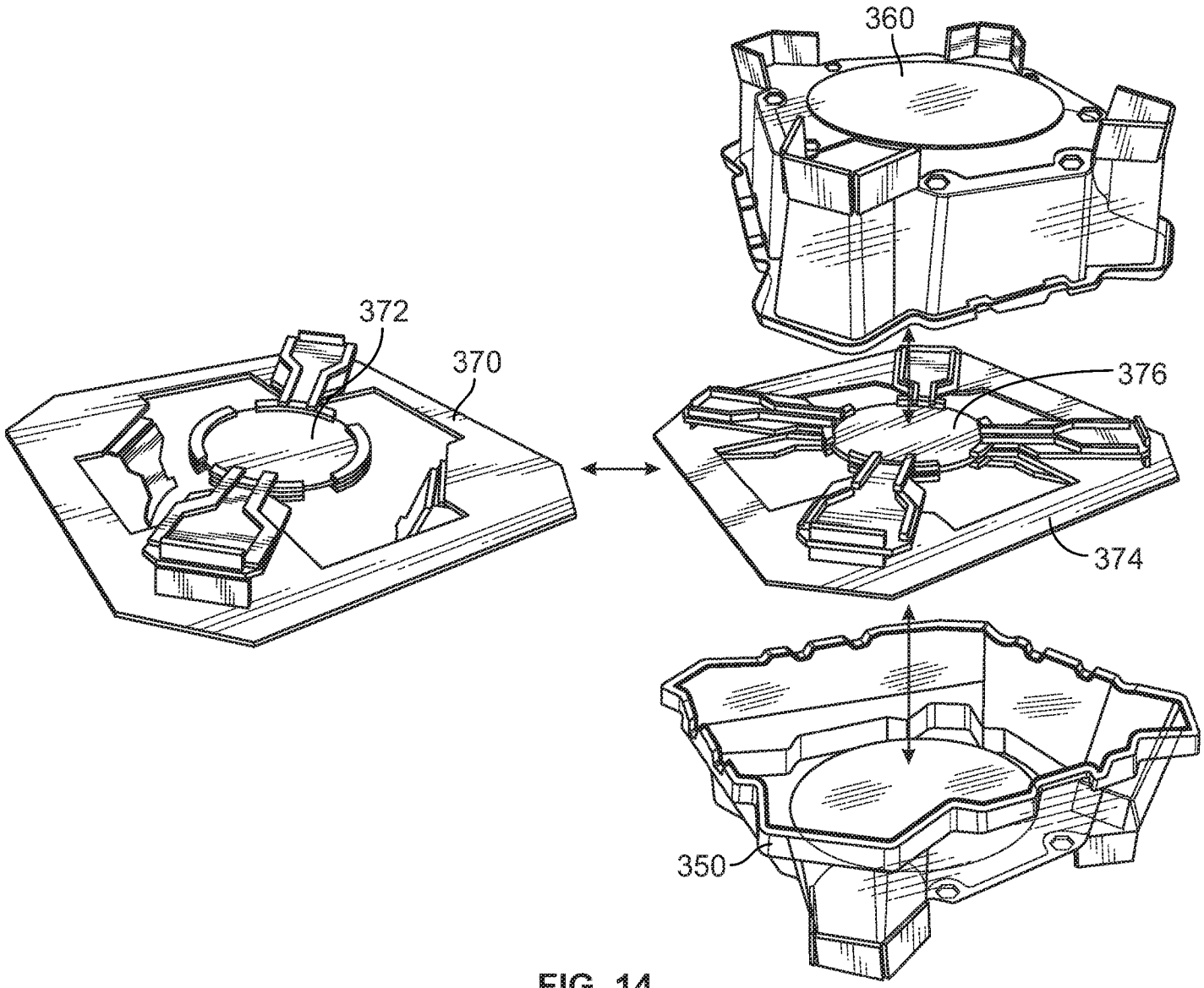
FIG. 14 is an exploded isometric view of the battle arena apparatus shown in FIGS. 12 and 13.

A variation of the inventive battle arena apparatus is shown in FIGS. 12-14, where a battle arena apparatus 350 is illustrated. The battle arena apparatus includes a first lid 352 with two main openings 354, 356 for receiving spinning battle tops from two players and a second lid 360 having four main openings 362, 364, 366, 368 for receiving spinning battle tops from up to four players. Located beneath the first lid 352, when the first lid 352 is facing the players, is a first base 370 having a battle surface 372, and located beneath the second lid 360, when the second lid 360 is facing the players, is a second base 374 having a battle surface 376. Each of the main openings of the first and second lids 352, 360, such as the main opening 356 in the first lid 352 and the main opening 368 in the second lid 360, are bordered by walls, such as the wall 380 bordering the main opening 356 and the wall 382 bordering the main opening 368. The bordering walls 380, 282 function to direct spinning tops into a corresponding main opening and act as stands for supporting the battle arena apparatus 350 on a support surface when the walls are lowermost when the game is to be played. The lids and bases may have the same types of connectors and openings to receive the connectors as the battle arena apparatus 10. Operation of battle arena apparatus 350 is the same as operation of the battle arena apparatus 10, as is assembly of the battle arena apparatus 350.

The battle arena apparatus disclosed in detail above have great play value, are fun to use and easy to operate. The apparatus are compact for shipping and yet easily assembled. The resulting assembled apparatus are robust and rugged, and may be produced at reasonable cost.

Figure 15:
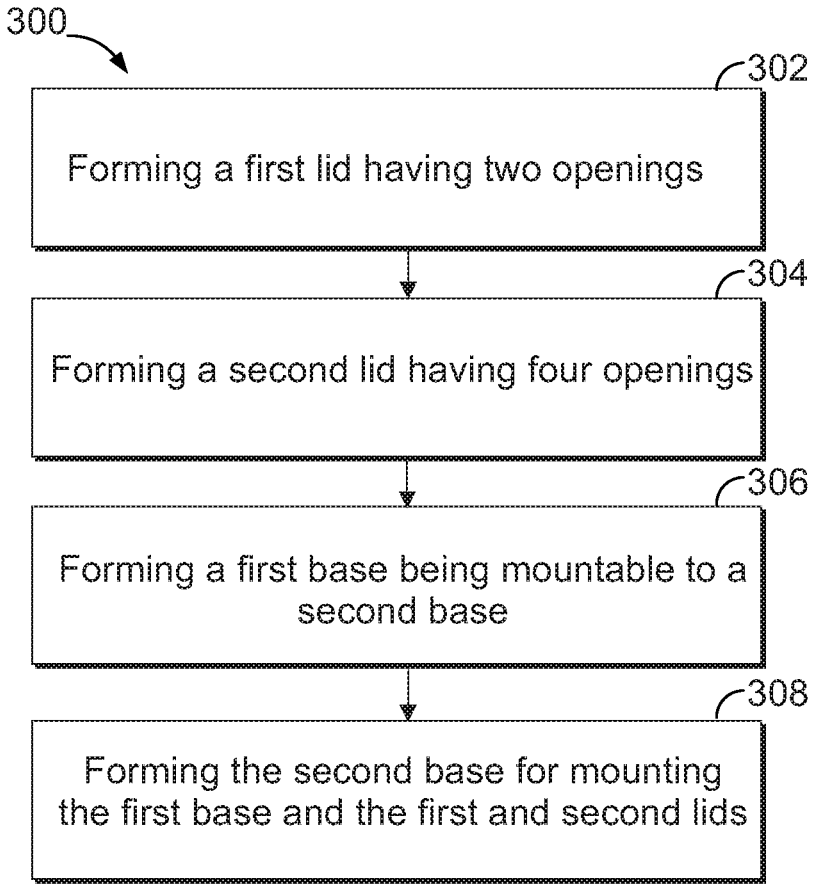
FIG. 15 is a flow diagram of a method of making a battle arena apparatus.

The present invention also includes a method 300, FIG. 15, for making a game battle arena apparatus including the steps of forming a first lid having two main openings 302 to enable up to two players to each insert a spinning battle top through a corresponding opening in the first lid, forming a second lid having four main openings 304 to enable up to four players to each insert a spinning battle top through a corresponding opening in the second lid, forming a first base being mountable to a second base 306, the first base having a game surface to enable spinning battle tops inserted through the first lid to engage each other in combat, and forming the second base for mounting the first base and for mounting the first and second lids 308, the second base having a game surface to enable multiple spinning battle tops inserted through the second lid to engage each other in combat.

The method for making a battle arena game apparatus further includes the step of forming a pair of opposed slanted slide regions flanking the game surface of the first base and mounted juxtaposed the two main openings of the first lid, and forming two pairs of opposed slanted slide regions flanking the game surface of the second base and mounted juxtaposed the four main openings of the second lid. The method further includes the step of combining with one or more spinning toy tops, each top having a tip suitable for gliding down the slide regions from the main openings to battle at the game surfaces, creating a one way flow of the one or more tops from the openings to the game surfaces to maximize collisions between actively spinning tops at the game surfaces. The method also includes the step of forming at least two play modes, having a first play mode accommodating up to two players when the battle arena game apparatus is placed in one orientation and a second play mode accommodating up to four players when placed in another orientation.

From the foregoing, it can be seen that the present inventions provide a unique battle arena game apparatus which accommodates two players when placed in one orientation and four players after being flipped to another orientation. The arena includes multiple launch openings and slide regions for guiding spinning toy battle tops to flow one way from the launch openings toward the battling surfaces for engaging the tops in combat. The circular wall at least partially forming a raised perimeter around each of the battling surfaces prevents spinning top from exiting the battling surfaces to maximize the frequency of collisions between actively spinning tops for enhanced game play and fun for the user. While particular embodiments and variations of the present invention have been shown and described in great detail, it will be obvious to those skilled in the art that changes and modifications may be made without departing from the invention in its broader aspects. Therefore, the aim is to cover all such changes and modifications as fall within the true spirit and scope of the invention. The matters set forth in the foregoing description and accompanying drawings are offered by way of illustrations only and not as limitations.

What is claimed is:

1. A battle arena game apparatus, comprising:

a first lid having two launch openings to enable two players to each insert a spinning battle top through a corresponding launch opening of the first lid;

a second lid having four launch openings to enable four players to each insert a spinning battle top through a corresponding launch opening of the second lid;

a first base having a battling surface to enable spinning battle tops inserted through the two launch openings of the first lid to engage each other in combat; and a second base for mounting the first and second lids and having a support surface and a battling surface, the support surface for mounting the first base, and the battling surface to enable spinning battle tops inserted through the four launch openings in the second lid to engage each other in combat.

2. The battle arena game apparatus according to claim 1, wherein the second base further comprises a first side and a second side, and a clam shell coupling mounting the first lid to the first side of the second base and a clam shell coupling mounting the second lid to second side of the second base.

3. The battle arena game apparatus according to claim 2, wherein the battling surfaces of each of the first and second bases further comprise a circular wall at least partially forming a raised perimeter around each of the battling surfaces.

4. The battle arena game apparatus according to claim 3, further comprising a pair of opposed slanted slide regions flanking the battling surface of the first base and mounted juxtaposed the two launch openings of the first lid.

5. The battle arena game apparatus according to claim 4, further comprising two pairs of opposed slanted slide regions flanking the battling surface of the second base and mounted juxtaposed the four launch openings of the second lid.

6. The battle arena game apparatus according to claim 5, wherein each of the slide regions are slanted toward a battling surface for directing spinning tops from the launch openings to a battling surface.

7. The battle arena game apparatus according to claim 6, in combination with one or more spinning toy tops, each top having a tip suitable for gliding down the slide regions from the launch openings to battle at the battling surfaces, and prevented by the circular wall from reentering the slide regions from the battling surfaces to create a one way flow of the one or more tops from the openings to the battling surfaces to maximize collisions between actively spinning tops at the battling surfaces.

8. The battle arena game apparatus according to claim 7, further comprising one or more electronic sensor devices capable of detecting and monitoring spinning tops on the battling surfaces and wirelessly communicating the spinning top activity to a personal electronic device of a user.

9. A clam shell battle arena game apparatus enabling two and four player Orientations, comprising:

a first clam shell housing having two launch openings to enable up to two players to each insert a spinning battle top through a corresponding launch opening of the first clam shell housing;

a second clam shell housing having four launch openings to enable up to four players to each insert a spinning battle top through a corresponding launch opening of the second clam shell housing;

a base unit having a first side and a second side, coupling to the first clam shell housing at the first side and coupling to the second clam shell housing at the second side;

a first battling surface at the first side of the base unit to enable spinning battle tops inserted through the two launch openings of the first clam shell opening to engage each other in combat; and a second battling surface at the second side of the base unit to enable spinning battle tops inserted through the launch openings in the second clam shell housing to engage each other in combat.

10. The clam shell battle arena game apparatus according to claim 9, wherein the first and second battling surfaces, further comprise a circular wall at least partially forming a raised perimeter around each of the battling surfaces.

11. The clam shell battle arena game apparatus according to claim 10, further comprising a pair of opposed slanted slide regions flanking the first battling surface and mounted juxtaposed the two launch openings of the first clam shell housing.

12. The clam shell battle arena game apparatus according to claim 11, further comprising two pairs of opposed slanted slide regions flanking the second battling surface and mounted juxtaposed the four launch openings of the second clam shell housing.

13. The clam shell battle arena game apparatus according to claim 12, wherein each of the slide regions are slanted toward a battling surface for directing spinning tops from the launch openings to a battling surface.

14. The clam shell battle arena game apparatus according to claim 13, in combination with one or more spinning toy tops, each top having a tip suitable for gliding down the slide regions from the launch openings to battle at the battling surfaces, and prevented by the circular wall from reentering the slide regions from the battling surfaces to create a one way flow of the one or more tops from the openings to the battling surfaces to maximize collisions between actively spinning tops at the battling surfaces.

15. The clam shell battle arena game apparatus according to claim 14, further comprising one or more electronic sensor devices capable of detecting and monitoring spinning tops on the battling surfaces and wirelessly communicating the spinning top activity to a personal electronic device of a user.

16. A method for making a battle arena game apparatus, comprising the steps of:

forming a first lid having two main openings to enable up to two players to each insert a spinning battle top through a corresponding opening in the first lid;

forming a second lid having four main openings to enable up to four players to each insert a spinning battle top through a corresponding opening in the second lid;

forming a first base being mountable to a second base, the first base having a game surface to enable spinning battle tops inserted through the first lid to engage each other in combat; and forming the second base for mounting the first base and for mounting the first and second lids, the second base having a game surface to enable multiple spinning battle tops inserted through the second lid to engage each other in combat.

17. The method for making a battle arena game apparatus according to claim 16, further comprising the step of forming a pair of opposed slanted slide regions flanking the game surface of the first base and mounted juxtaposed the two main openings of the first lid.

18. The method for making a battle arena game apparatus according to claim 17, further comprising the step of forming two pairs of opposed slanted slide regions flanking the game surface of the second base and mounted juxtaposed the four main openings of the second lid.

19. The method for making a battle arena game apparatus according to claim 18, further comprising the step of combining with one or more spinning toy tops, each top having a tip suitable for gliding down the slide regions from the main openings to battle at the game surfaces, creating a one way flow of the one or more tops from the openings to the game surfaces to maximize collisions between actively spinning tops at the game surfaces.

20. The method for making a battle arena game apparatus according to claim 19, further comprising the step of forming at least two play modes, having a first play mode accommodating up to two players when the battle arena game apparatus is placed in one orientation and a second play mode accommodating up to four players when placed in another orientation.

* * * * *